US009700140B2

(12) United States Patent
Lawson

(10) Patent No.: US 9,700,140 B2
(45) Date of Patent: Jul. 11, 2017

(54) ZERO-WALL CLEARANCE LINKAGE MECHANISM INCLUDING A SINGLE DRIVE LINK

(71) Applicant: L&P PROPERTY MANAGEMENT COMPANY, South Gate, CA (US)

(72) Inventor: Gregory Mark Lawson, Tupelo, MS (US)

(73) Assignee: L&P Property Management Company, South Gate, CA (US)

( * ) Notice: Subject to any disclaimer, the term of this patent is extended or adjusted under 35 U.S.C. 154(b) by 289 days.

(21) Appl. No.: 14/667,011

(22) Filed: Mar. 24, 2015

(65) Prior Publication Data

US 2015/0289655 A1 Oct. 15, 2015
US 2017/0135486 A9 May 18, 2017

Related U.S. Application Data

(62) Division of application No. 14/064,700, filed on Oct. 28, 2013, now Pat. No. 9,386,587.

(60) Provisional application No. 61/969,551, filed on Mar. 24, 2014.

(51) Int. Cl.
*A47C 1/034* (2006.01)
*A47C 7/00* (2006.01)
*A47C 1/032* (2006.01)

(52) U.S. Cl.
CPC ..... *A47C 1/0342* (2013.01); *A47C 1/0345* (2013.01); *A47C 1/03211* (2013.01)

(58) Field of Classification Search
CPC . A47C 1/03211; A47C 1/0342; A47C 1/0345; A47C 1/035; A47C 1/0352; A47C 1/0355; A47C 17/163
See application file for complete search history.

(56) References Cited

U.S. PATENT DOCUMENTS 5,312,153 A 5/1994 Lin
5,466,046 A * 11/1995 Komorowski ..... A47C 1/0345 297/325

(Continued)

OTHER PUBLICATIONS

International Search Report and Written Opinion dated Jun. 22, 2015 in Application No. PCT/US2015/022214, 9 pages.

(Continued)

*Primary Examiner* — David R Dunn
*Assistant Examiner* — Tania Abraham
(74) *Attorney, Agent, or Firm* — Shook, Hardy & Bacon L.L.P.

(57) ABSTRACT

A seating unit that includes a linkage mechanism adapted to adjust between closed, extended, and reclined positions is provided. The linkage mechanism includes an adjustment mechanism having a motor and a track that is coupled to the motor and that extends from a front portion of the seating unit to a rear portion of the seating unit. The linkage mechanism also includes a motor activator block slidably coupled to the track and movable along the track using the motor, as well as a single drive link that is attached to the motor activator block. The motor activator block includes a carriage body that slidably attaches the motor activator block to the track and one or more mounting tabs that extend from the carriage body toward the rear portion of the seating unit and that are coupled to the single drive link.

19 Claims, 23 Drawing Sheets

(56) References Cited

U.S. PATENT DOCUMENTS

| | | | | |
|---|---|---|---|---|
| 5,992,931 | A * | 11/1999 | LaPointe | A47C 1/0345 297/330 |
| 7,641,277 | B2 * | 1/2010 | Lawson | A47C 1/0355 297/85 L |
| 8,201,877 | B2 * | 6/2012 | Hsieh | A47C 1/0242 297/330 |
| 8,979,186 | B2 * | 3/2015 | Walz | A47C 1/0242 297/68 |
| 2001/0028183 | A1 * | 10/2001 | Wiecek | A47C 1/035 297/84 |
| 2008/0290710 | A1 * | 11/2008 | Lawson | A47C 1/0345 297/337 |
| 2009/0256402 | A1 | 10/2009 | Smith | |
| 2011/0181094 | A1 * | 7/2011 | Lawson | A47C 1/035 297/85 R |
| 2011/0193373 | A1 * | 8/2011 | Lawson | A47C 1/035 297/71 |
| 2013/0049411 | A1 | 2/2013 | Lapointe | |
| 2014/0021760 | A1 | 1/2014 | Masters | |
| 2014/0070588 | A1 * | 3/2014 | Wittenberg, Jr. | A47C 1/03211 297/362.11 |
| 2014/0091601 | A1 * | 4/2014 | Breen | A47C 1/0355 297/68 |

OTHER PUBLICATIONS

International Preliminary Report on Patentability dated Oct. 6, 2016 in International Application No. PCT/US2015/022214, 8 pages.

* cited by examiner

ZERO-WALL CLEARANCE LINKAGE MECHANISM INCLUDING A SINGLE DRIVE LINK

CROSS-REFERENCE TO RELATED APPLICATIONS

This application is a divisional of, and claims priority to, U.S. patent application Ser. No. 14/064,700 (filed on Oct. 28, 2013, and issuing as U.S. Pat. No. 9,386,857), which is incorporated by reference herein in its entirety. This application also claims priority to provisional application U.S. 61/969,551 (filed Mar. 24, 2014), which is incorporated herein by reference in its entirety.

BACKGROUND

The present invention relates broadly to motion upholstery furniture designed to support a user's body in an essentially seated disposition. Motion upholstery furniture includes recliners, incliners, sofas, love seats, sectionals, theater seating, traditional chairs, and chairs with a moveable seat portion, such furniture pieces being referred to herein generally as "seating units." More particularly, the present invention relates to an improved linkage mechanism developed to accommodate a wide variety of styling for a seating unit, which is otherwise limited by the configurations of linkage mechanisms in the field. Additionally, the improved linkage mechanism of the present invention provides for reclining a seating unit that is positioned against a wall or placed within close proximity of other fixed objects.

Reclining seating units exist that allow a user to forwardly extend a footrest and to recline a backrest rearward relative to a seat. These existing seating units typically provide three basic positions (e.g., a standard, non-reclined closed position; an extended position; and a reclined position). In the closed position, the seat resides in a generally horizontal orientation and the backrest is disposed substantially upright. Additionally, if the seating unit includes one or more ottomans attached with a mechanical arrangement, the mechanical arrangement is collapsed such that the ottoman(s) are not extended. In the extended position, often referred to as a television ("TV") position, the ottoman(s) are extended forward of the seat, and the backrest remains sufficiently upright to permit comfortable television viewing by an occupant of the seating unit. In the reclined position the backrest is pivoted rearward from the extended position into an obtuse relationship with the seat for lounging or sleeping.

Several modern seating units in the industry are adapted to provide the adjustment capability described above. However, these seating units require relatively complex linkage mechanisms to afford this capability. The complex linkage assemblies limit certain design aspects when incorporating automation. In particular, these linkage assemblies impose constraints on incorporating a single motor for automating adjustment between the positions mentioned above, and require two or more motors to accomplish automation of each adjustment. For instance, achieving a full range of motion when automatically adjusting between positions conventionally requires a plurality of large motors each with a substantial stroke. (The geometry of the linkage assembly prohibits mounting a single large motor thereto without interfering with crossbeams, the underlying surface, or moving parts attached to the linkage assembly.) As such, a more refined linkage mechanism that achieves full movement when being automatically adjusted between the closed, extended, and reclined positions would fill a void in the current field of motion-upholstery technology.

In addition, the lack of lateral adjustment offered by the conventional complex linkage mechanisms disadvantageously requires the entire seating unit to be moved outwardly away from an adjacent wall. Thus, the conventional complex linkage mechanisms require the seating unit to occupy a larger area of a room. Otherwise, without providing substantial clearance between the backrest and the adjacent wall, the backrest in the reclined position will contact the adjacent wall.

Further, when employing motorized adjustment to the conventional complex linkage mechanisms, the seating unit housing these mechanisms is susceptible to tipping forward when adjusted to the reclined position. Tipping is generally caused by an occupant of the seating unit leaning forward while a motor, or other automated mechanism, disallows the collapse of a footrest assembly, which hold the ottoman(s) outward from the seating unit. Accordingly, the occupant is generally obligated to invoke the motorized adjustment when leaning forward in the seating unit to avoid upsetting the seating unit.

Even further, motorized adjustment of the conventional complex linkage mechanisms often causes the ottoman(s) and the backrest of the seating unit to move out of sequence. For example, when adjusting from the closed position to the extended position, a pressure generated by the occupant's legs on the ottoman(s) may cause resistance in extending the footrest assembly. As a result of the resistance, the motorized adjustment may commence reclining the backrest out of sequence until full travel of a predefined stroke is attained.

Accordingly, embodiments of the present invention pertain to a novel linkage mechanism that allows a seating unit to provide a space-saving utility that overcomes the need for considerable wall clearance. Further, the linkage mechanism of the invention is constructed in a simple and refined arrangement in order to provide suitable function while overcoming the above-described, undesirable features inherent within the conventional complex linkage mechanisms.

SUMMARY

Embodiments of the present invention seek to provide a simplified linkage mechanism that can be assembled to a compact motor and that can be adapted to essentially any type of seating unit. In an exemplary embodiment, the compact motor in concert with the linkage mechanism can achieve full movement and sequenced adjustment of the seating unit between the closed, extended, and reclined positions. The compact motor may be employed in a proficient and cost-effective manner to adjust the linkage mechanism without creating interference or other disadvantages appearing in the conventional designs that are inherent with automation. The linkage mechanism may be configured with features that assist in preventing tipping of the seating unit, sequencing the seating-unit adjustment between positions, locking a footrest assembly in an extended position, and curing other disadvantages appearing in the conventional designs. Various drive-link configurations might be utilized, such as a single drive link or a multi-drive-link assembly.

Generally, the novel seating unit includes the following components: first and second foot-support ottomans; a pair of base plates in substantially parallel-spaced relation; a pair of seat-mounting plates in substantially parallel-spaced relation, a seating support surface extending between the seat-mounting plates; and a pair of the generally mirror-image linkage mechanisms that interconnect the base plates to the seat-mounting plates. Additionally, the seat-mounting plates are disposed in an inclined orientation in relation to a surface underlying the seating unit. In operation, the linkage mechanisms are adapted to move between a closed position, an extended position, and a reclined position.

Typically, the linkage mechanisms include a pair of footrest assemblies that movably interconnect the first and second foot-support ottomans to the seat-mounting plates. In instances, the linkage mechanisms each include a seat-adjustment assembly with a rear bellcrank that is adapted to translate the respective seat-mounting plates over the base plates during adjustment between the closed position, the extended position, and the reclined position. In embodiments, the rear bellcrank translates a respective seat-mounting plate while maintaining the seat-mounting plate's inclined orientation relationship to the base plates. As such, the seating support surface may be biased at a particular inclination angle throughout adjustment.

In another embodiment, each of the linkage mechanisms includes a sequence plate and a sequence element. The sequence plate includes a guide slot that is configured with a first region, a second region, and an intermediate region that interconnects the first region and the second region. The sequence element generally extends into the guide slot. In operation, the sequence element resides within the first region when the seating unit is adjusted between the extended and reclined position, within the intermediate region when the seating unit is adjusted to the extended position, and within the second region when the seating unit is adjusted between the extended position and the closed position. As such, when moving from the closed position to the extended position, the backrest is restrained from inadvertently reclining. Also, when moving from the reclined position to the extended position, the footrest assembly is restrained from inadvertently collapsing or closing.

In a further embodiment, a rotation-limiting mechanism helps to limit incline and recline of the linkage mechanism. For example, the rotation-limiting mechanism helps to limit forward rotation of a back portion of a seating unit when the linkage mechanism is in a closed position and the seating unit is in an upright position. In addition, the rotation-limiting mechanism also helps to support the linkage when the linkage is opened to a fully reclined position. An exemplary rotation-limitation mechanism includes a stop element fixed at a position on the linkage mechanism to limit the range of motion of one or more links of the linkage mechanism.

BRIEF DESCRIPTION OF THE DRAWINGS

In the accompanying drawings that form a part of the specification and that are to be read in conjunction therewith, and in which like reference numerals are used to indicate like parts in the various views.

DETAILED DESCRIPTION OF THE INVENTION

The subject matter of embodiments of the present invention is described with specificity herein to meet statutory requirements. But the description itself is not intended to necessarily limit the scope of claims. Rather, the claimed subject matter might be embodied in other ways to include different elements or combinations of elements similar to the ones described in this document, in conjunction with other present or future technologies.

Figure 1:
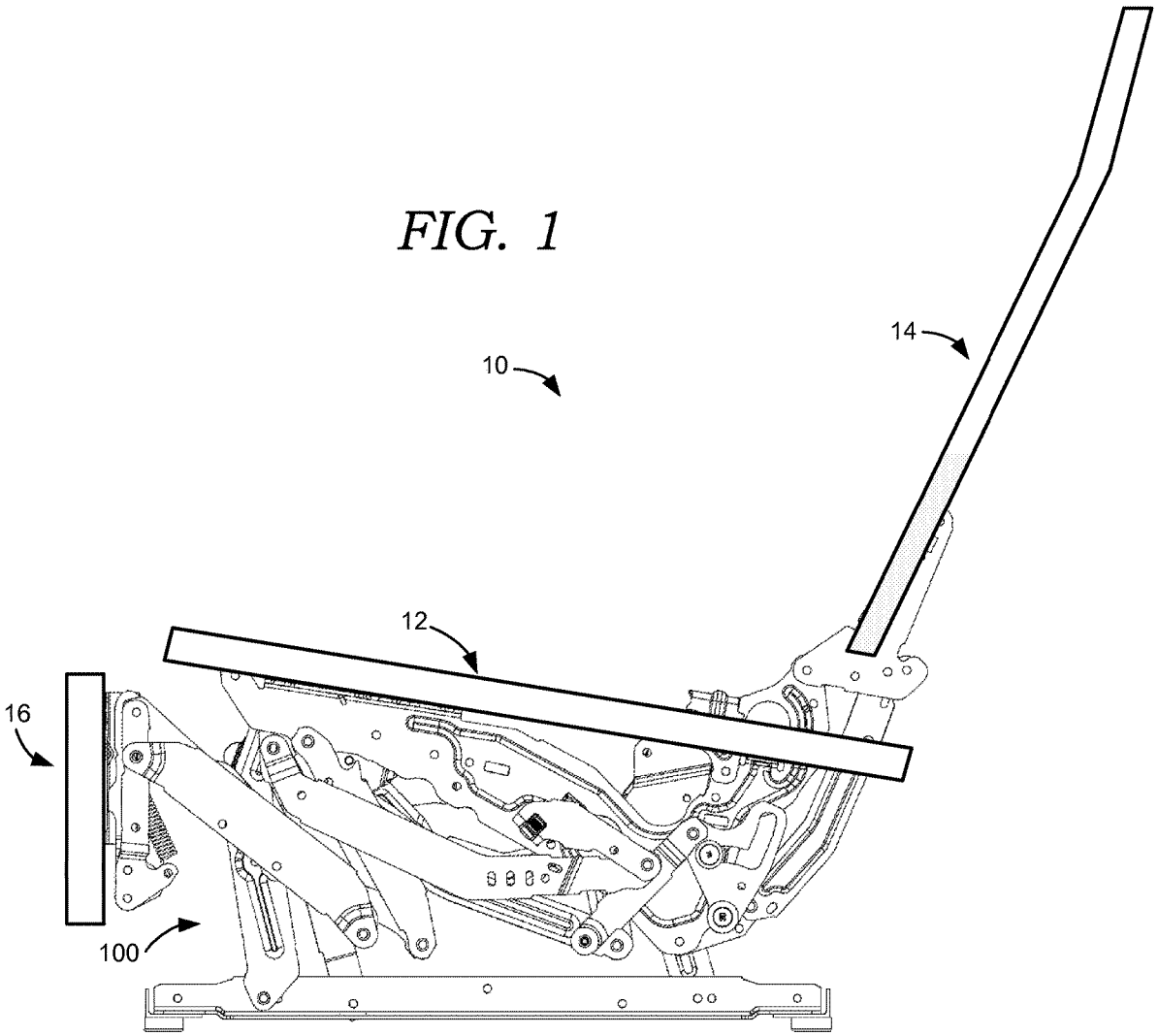
FIG. 1 is a side view of part of a seating unit in a closed position, in accordance with an embodiment of the present invention.
Figure 2:
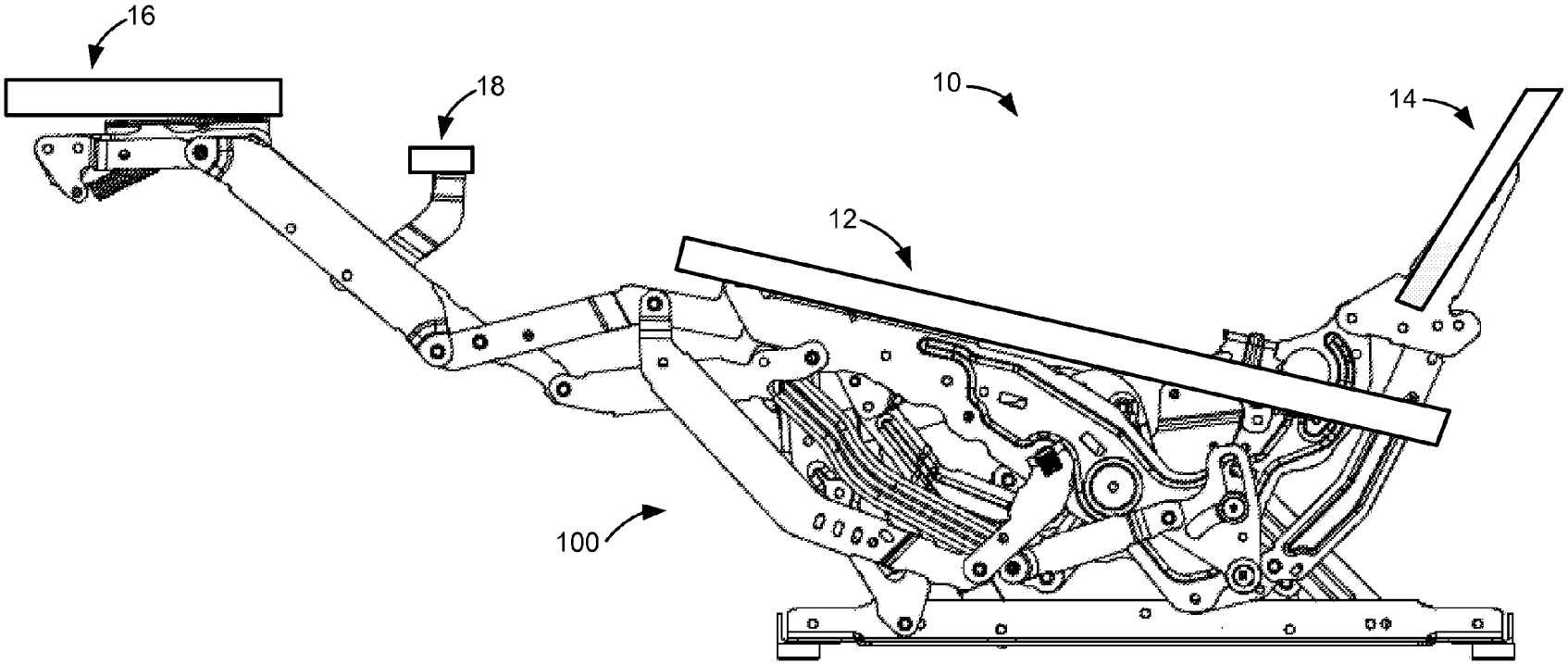
FIG. 2 is a view similar to FIG. 1, but in an extended position, in accordance with an embodiment of the present invention.
Figure 3:
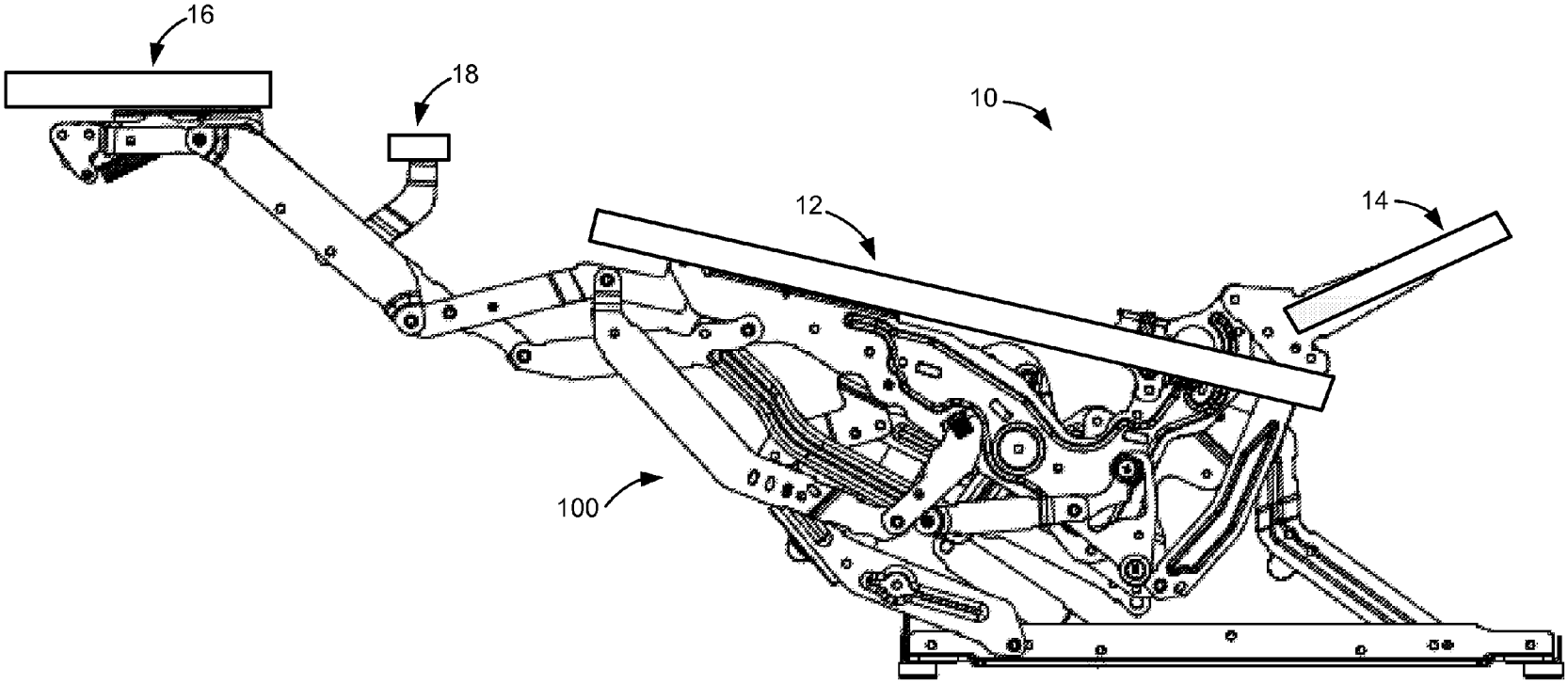
FIG. 3 is a view similar to FIG. 1, but in a reclined position, in accordance with an embodiment of the present invention.

FIGS. 1-3 illustrate part of a seating unit 10, which is depicted in a closed position in FIG. 1, an extended position (TV position) in FIG. 2, and a reclined position in FIG. 3. For illustrative purposes, FIGS. 1-3 show only some of the elements that could be included in the seating unit 10, and various other possible components have been omitted. Generally, seating unit 10 has a seat substructure 12, a backrest substructure 14, a linkage mechanism 100, a first ottoman substructure 16, and a second ottoman substructure 18 (FIG. 2). The seat substructure 12 and the backrest substructure 14 are moveable relative to a base of the seating unit 10 and relative to one another as illustrated by the different positions depicted among FIGS. 1-3. In embodiments, the linkage mechanism 100 facilitates movement of the seating unit 10 into the positions depicted in FIGS. 1-3. That is, the linkage mechanism 100 is arranged to articulably actuate and control movement of the seat substructure 12, the backrest substructure 14, and the ottomans 16 and 18 between the positions shown in FIGS. 1-3, as more fully described below.

FIG. 1 depicts the seating unit 10 adjusted to the closed position, which is a normal non-reclined sitting position with the substructure 12 in a generally horizontal position and the backrest substructure 14 generally upright and in a substantial perpendicular biased relation to the seat substructure 12. In particular, the seat substructure 12 might be disposed in a slightly inclined orientation relative to a base of the seating unit 10. In one embodiment of the present invention, the inclined orientation may be maintained throughout adjustment of the seating unit 10 between the non-reclined position, the extended position, and the reclined position. When in the closed position, the ottoman substructures 16 and 18 are positioned substantially below the seat substructure 12 and other seat structures of the seating unit 10.

Turning to FIG. 2, the extended position (TV position) is depicted. When the seating unit 10 is adjusted to the extended position, the first ottoman structure 16 and the second ottoman structure 18 are extended out from underneath of a seat of the seating unit 10. In addition, the backrest remains substantially perpendicular to the seat. As will be described in more detail in other parts of this description, because a seat plate of the seating unit is moved forward (i.e., to the left with respect to the views depicted in FIGS. 1-3), the backrest of the seating unit does not encroach an adjacent wall (i.e., positioned to the right of the view depicted in FIGS. 1-3) when the seating unit 10 is moved into the extended position. The seat substructure 12 is maintained in the inclined orientation relative a seating-unit base. Thus, the configuration of the seating unit 10 in the extended position depicted by FIG. 2 provides an occupant a reclined TV position while providing space-saving utility.

FIG. 3 depicts the reclined position, in which the seating unit 10 is fully reclined. The backrest substructure 14 is rotated rearward by the linkage mechanism 100 and biased in a rearward inclination angle. The rearward inclination angle is typically an obtuse angle in relation to the seat substructure 12. However, the rearward inclination angle of the backrest is offset by a forward and upward translation of the seat 12 as controlled by the linkage mechanism 100. This is in contrast to some other reclining chairs with 3-position mechanisms, which cause their backrest to move rearward during adjustment, thereby requiring that the reclining chair be positioned a considerable distance from an adjacent rear wall or other proximate fixed objects. Thus, the forward and upward translation of the seat substructure 12 in embodiments of the present invention allow for zero-wall clearance. Generally, the "zero-wall clearance" is utilized herein to refer to space-saving utility that permits positioning the seating unit 10 in close proximity to an adjacent rear wall and other fixed objects. In embodiments of the present invention, the ottomans 16 and 18 might be moved farther forward and upward when moved from the extended position to the reclined position.

As indicated above, FIGS. 1-3 show only some of the elements of the seating unit 10; however, in other embodiments of the present invention, the seating unit 10 includes various other components, such as armrests, legs, and the like. For example, in the context of a pivot-over-arm (POA) style chair, an arm would be interconnected with the seat and linkage mechanism 100, such that the legs of the seating unit would not directly support the arm. Rather, the legs support an underlying frame of the seating unit 10, such that the seat is movable together with the arm. In a POA configuration the backrest might include a wing portion that extends above the armrest and that pivots around the rear portion of the armrest when the backrest reclines. In an alternative configuration, known as a frame-within-a-frame style, the arm is stationary with respect to the seat 12, which is adjustable via the linkage mechanism. In this embodiment, the seat 12 is moveable during adjustment of the seating unit 10, but the arm remains relatively stationary.

Figure 5:
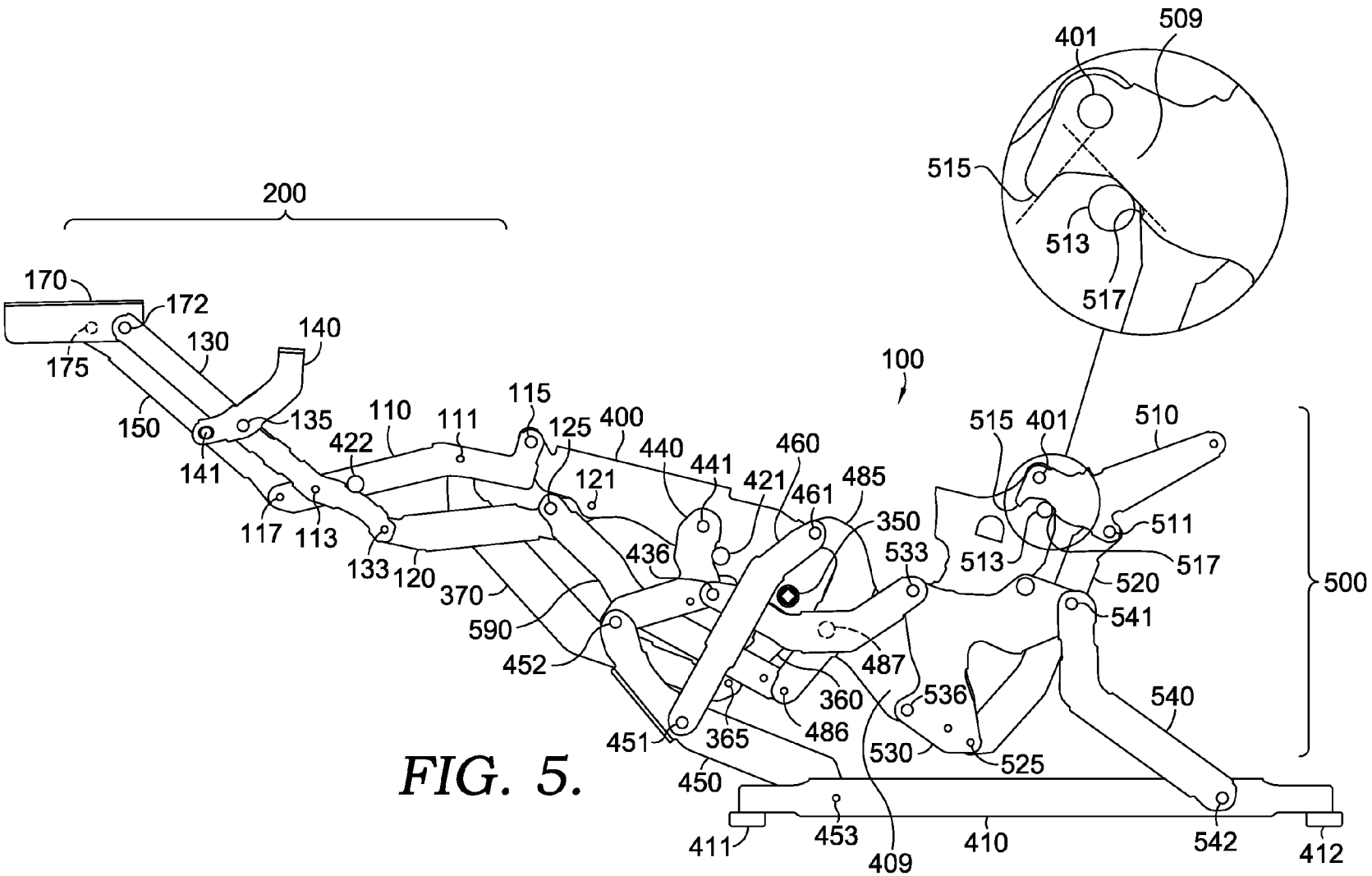
FIG. 5 is a diagrammatic lateral view of the linkage mechanism in the reclined position from a vantage point internal to the seating unit, in accordance with an embodiment of the present invention.
Figure 6:
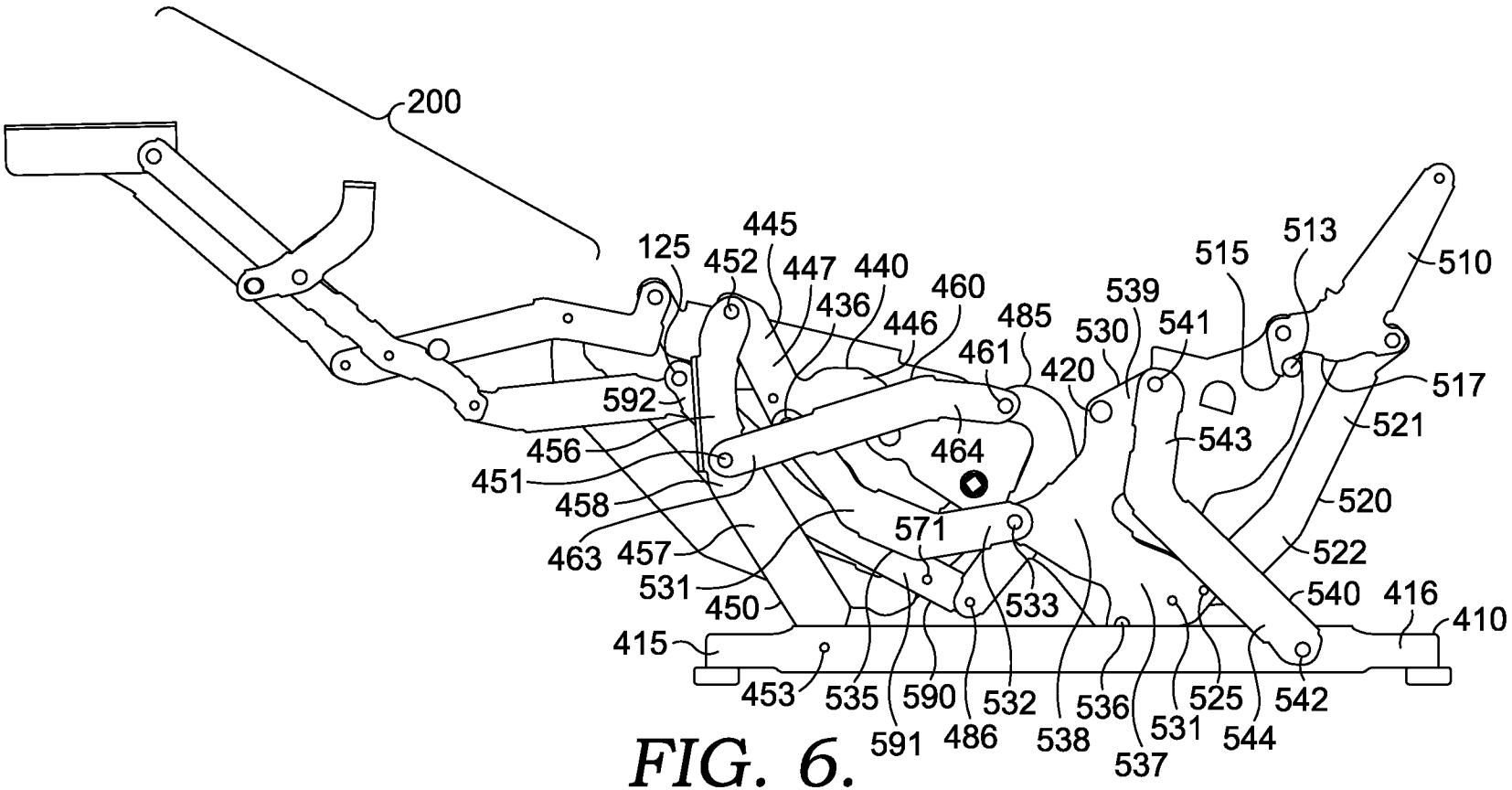
FIG. 6 is a view similar to FIG. 5, but in the extended position, in accordance with an embodiment of the present invention.
Figure 7:
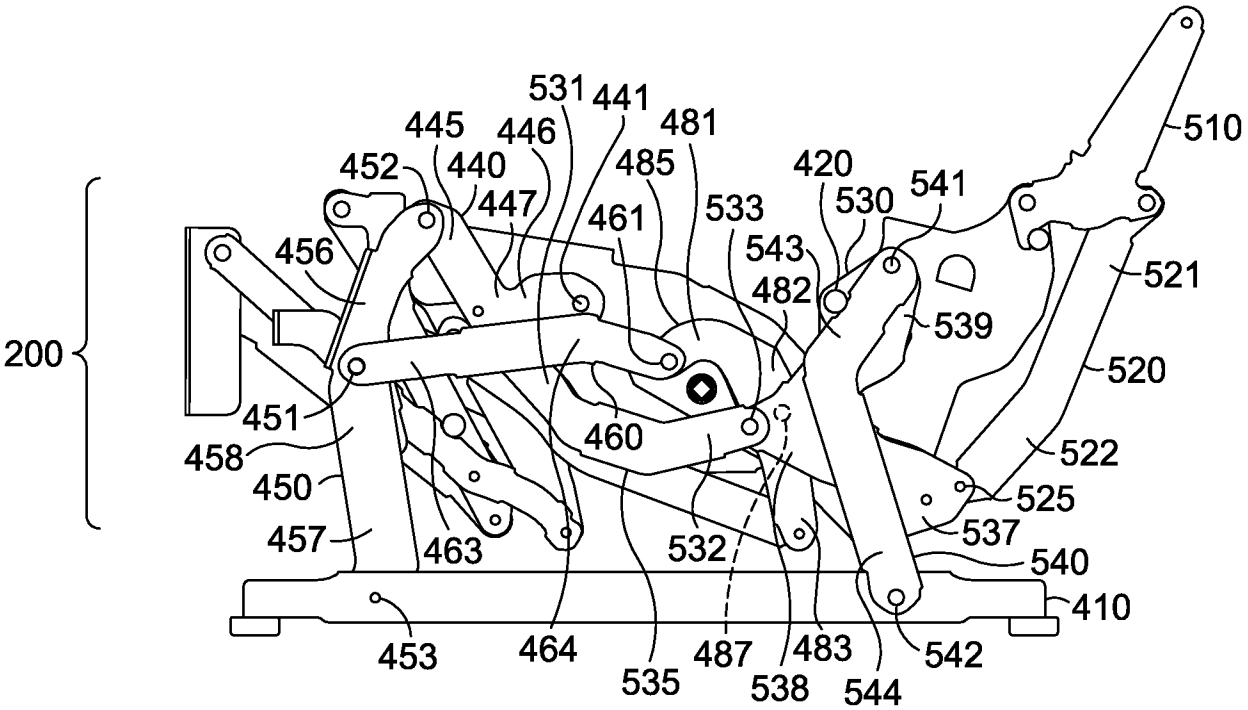
FIG. 7 is a view similar to FIG. 5, but in the closed position, in accordance with an embodiment of the present invention.

FIGS. 4-7 illustrate the configuration of the linkage mechanism 100 for a manually adjustable, zero-wall clearance, seating unit 10 (hereinafter the "seating unit") that is designed to provide additional layout when adjusted to the reclined position. As discussed above, the linkage mechanism 100 is arranged to articulably actuate and control movement of a seat, a backrest, and ottoman(s) of the seating unit between the positions shown in FIGS. 4-7. That is, the linkage mechanism 100 is adjustable to a reclined position (FIGS. 4 and 5), an extended (TV) position (FIG. 6), and a closed position (FIG. 7). In the reclined position, the backrest is rotated rearward and biased in a rearward inclination angle, which is an obtuse angle in relation to the seat. When the seating unit 10 is manually adjusted to the extended position, the ottoman(s) remain extended forward, while the backrest is angularly biased substantially perpendicular to the seat. The closed position is configured as a non-reclined sitting position with the seat in a generally horizontal position and the backrest remaining generally upright. During adjustment between the closed, extended, and reclined positions, the linkage mechanism 100 includes a seat-adjustment assembly 500 with a rear bellcrank 530 that is adapted to translate a seat-mounting plate 400 over a base plates 410 in a consistent inclined orientation relative to the base plates 410.

Further, the linkage mechanism 100 comprises a plurality of other linkages that are arranged to actuate and control movement of the seating unit during movement between the closed, the extended, and the reclined positions. These linkages may be pivotably interconnected. It is understood and appreciated that the pivotable couplings (illustrated as pivot points in the figures) between these linkages can take a variety of configurations, such as pivot pins, bearings, traditional mounting hardware, rivets, bolt and nut combinations, or any other suitable fasteners which are well-known in the furniture-manufacturing industry. Further, the shapes of the linkages and the brackets may vary, as may the locations of certain pivot points. It will be understood that when a linkage is referred to as being pivotably "coupled" to, "interconnected" with, "attached" on, etc., another element (e.g., linkage, bracket, frame, and the like), it is contemplated that the linkage and elements may be in direct contact with each other, or other elements, such as intervening elements, may also be present.

Generally, the linkage mechanism 100 guides the rotational movement of the backrest, the seat, and the ottoman(s). In an exemplary configuration, these movements are controlled by a pair of essentially mirror-image linkage mechanisms (one of which is shown herein and indicated by reference numeral 100), which comprise an arrangement of pivotably interconnected linkages. The linkage mechanisms are disposed in opposing-facing relation about a longitudinally-extending plane that bisects the seating unit between the pair of opposed arms. As such, the ensuing discussion will focus on only one of the linkage mechanisms 100, with the content being equally applied to the other complimentary linkage assembly.

Figure 4:
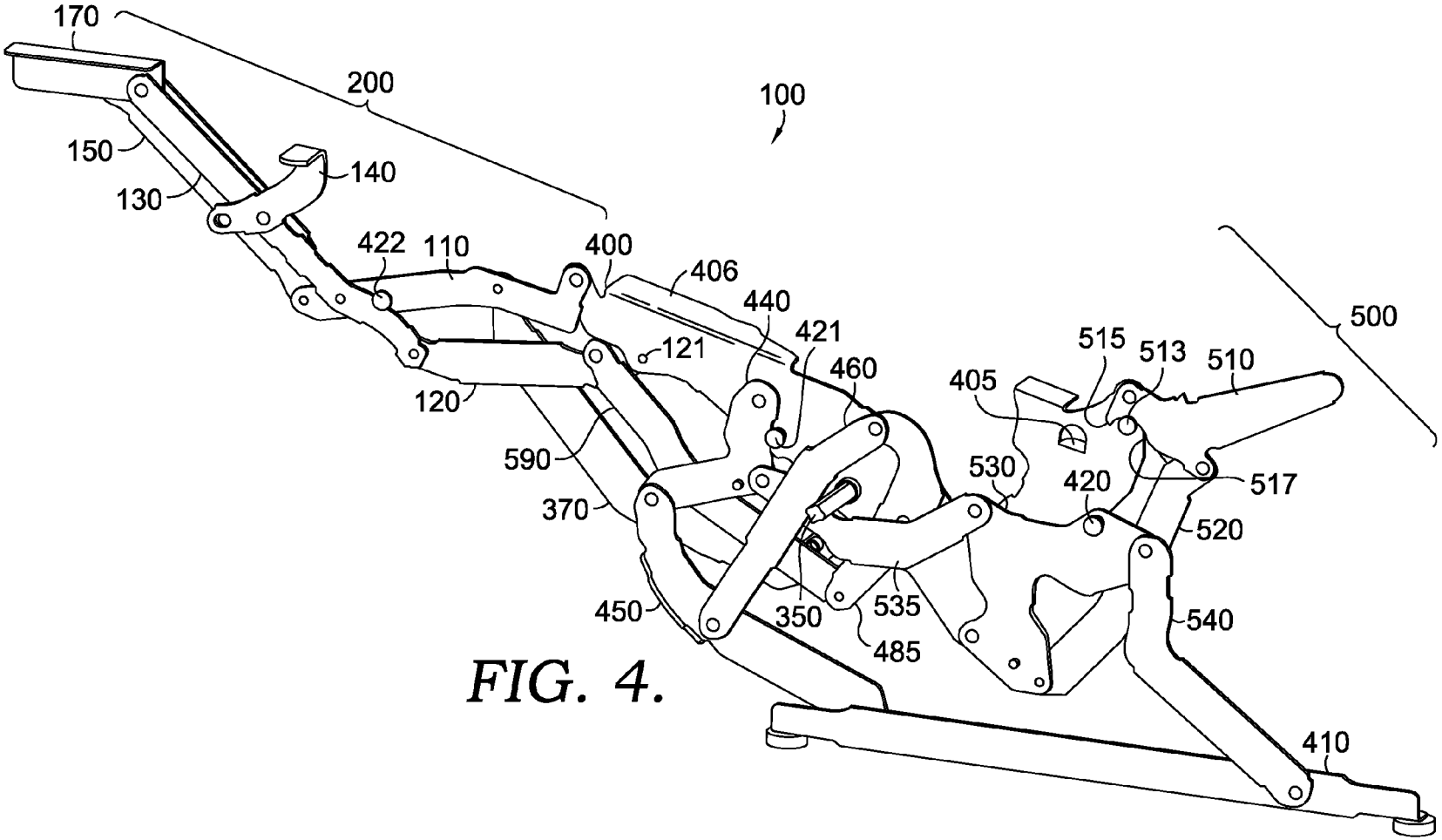
FIG. 4 is a perspective view of a linkage mechanism in the reclined position, in accordance with an embodiment of the present invention.

With continued reference to FIG. 4, a partial perspective view of the linkage mechanism 100 in the reclined position is shown, in accordance with an embodiment of the present invention. In embodiments, the linkage mechanism 100 includes a footrest assembly 200, the seat-mounting plate 400, the base plate 410, and a seat-adjustment assembly 500. Footrest assembly 200 is comprised of a plurality of links arranged to extend and collapse the ottoman(s) during adjustment of the seating unit from the extended position to the closed position, respectively. Seat-mounting plate 400 is configured to fixedly mount to the seat substructure 12 (FIGS. 1-3), and, in conjunction with an opposed seat-mounting plate, define a seat support surface (not shown). Seat-adjustment assembly 500 includes a back-mounting link 510, the rear bellcrank 530, a sequence link 550 (see FIGS. 11-14), and a plurality of other links. Generally, the seat-adjustment assembly 500 is adapted to recline and incline the backrest substructure 14 (FIGS. 1-3), which is coupled to the back-mounting link 510, and to laterally translate the seat substructure 12, which is coupled to the seat-mounting plate 400.

With reference to FIGS. 4-7, the components of the linkage mechanism 100 will now be discussed in detail. As briefly mentioned above, the linkage mechanism 100 includes the footrest assembly 200, the seat-mounting plate 400, the base plate 410, and the seat-adjustment assembly 500. The footrest assembly 200 includes a front ottoman link 110, a rear ottoman link 120, an inner ottoman link 130, a mid-ottoman bracket 140, an outer ottoman link 150, and a footrest bracket 170. Front ottoman link 110 is rotatably coupled to the seat-mounting plate 400 at pivot 115. The front ottoman link 110 is pivotably coupled to the inner ottoman link 130 at pivot 113 and the outer ottoman link 150 at pivot 117. Further, the front ottoman link 110 includes a front stop element 422 for ceasing adjustment from the closed position to the extended position upon the inner ottoman link 130 making contact therewith.

The front ottoman link 110 is also pivotably coupled to a footrest lock link 370 at pivot 111. Footrest lock link 370 is indirectly coupled with the activator bar 350 via an activator bracket 360 (FIGS. 5 and 11), where the activator bar 350 is manually or automatically rotated to control the extension or the collapse of the footrest assembly 200. The pivotable coupling 111 between the footrest lock link 370 and the front ottoman link 110, as opposed to the rear ottoman link 120, provides an over-center locking configuration that reduces slack or drooping of the footrest assembly 200 when in the closed position (FIG. 7). In other words, the pivotable coupling 111 of the footrest lock link 370 is located forward of a comparable pivot-connection location in other mechanisms. This forward location of pivot 111 removes potential slack contributors within the links behind the footrest assembly 200.

Rear ottoman link 120 is rotatably coupled to the seat-mounting plate 400 at pivot 121 and pivotably coupled to the inner ottoman link 130 at pivot 133. Further, the rear ottoman link 120 is pivotably coupled to a footrest drive link 590, of the seat-adjustment assembly 500, at pivot 125. During adjustment between the closed and extended positions, a forward directional force transferred by both the footrest drive link 590 to the pivot 125 and the footrest lock link 370 to pivot 111 causes the footrest assembly 200 to push out to the extended position.

Inner ottoman link 130 is pivotably coupled on one end to the rear ottoman link 120 at the pivot 133 and the front ottoman link 110 at the pivot 113. At an opposite end, the inner ottoman link 130 is pivotably coupled to the footrest bracket 170 at pivot 172. Between the ends of the inner ottoman link 130, the mid-ottoman bracket 140 is pivotably coupled thereto at pivot 135. Mid-ottoman bracket 140 is also pivotably coupled to the outer ottoman link 150 at pivot 141. Outer ottoman link 150 is further pivotably coupled to the front ottoman link 110 at the pivot 117 and to the footrest bracket 170 at pivot 175.

Seat-adjustment assembly 500 includes the activator bracket 360 (FIGS. 5 and 11), the footrest lock link 370, a front lift link 440, a front pivot link 450, a carrier link 460, a front bellcrank 485, a back-mounting link 510, a rear control link 520, the rear bellcrank 530, a bridge link 535, a rear pivot link 540, the sequence plate 550 that has a guide slot 555 formed therein, a sequence element 560 that travels within the guide slot 555, a front sequence link 570, and the footrest drive link 590. The activator bar 350 is rotatably coupled to the seat-mounting plate 400. Generally, the activator bar 350 spans the chassis of the seating unit, as shown in FIG. 8, and rotatably couples with a complimentary seat mounting plate of a mirror-image linkage mechanism as well.

Figure 11:
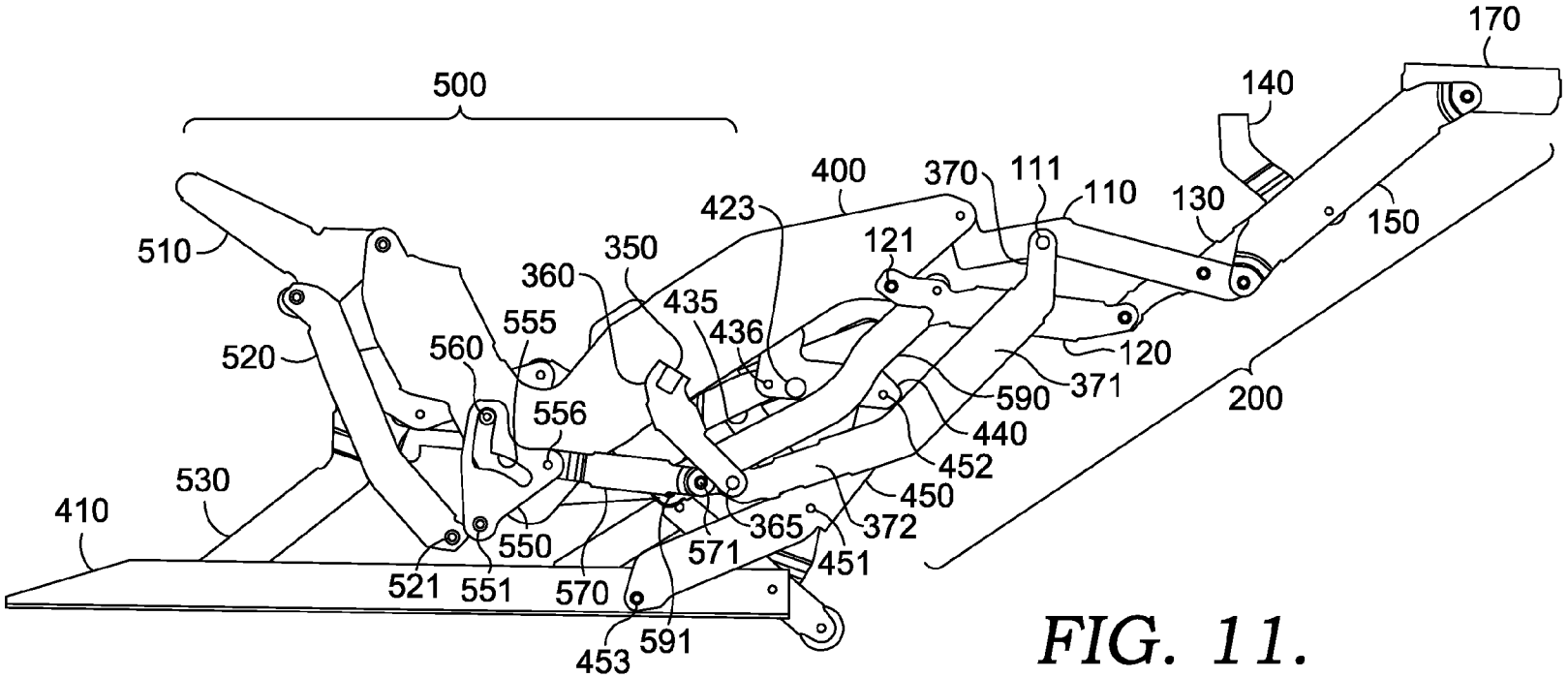
FIG. 11 is a diagrammatic lateral view of the linkage mechanism in the reclined position from a vantage point external to the seating unit, in accordance with an embodiment of the present invention.
Figure 13:
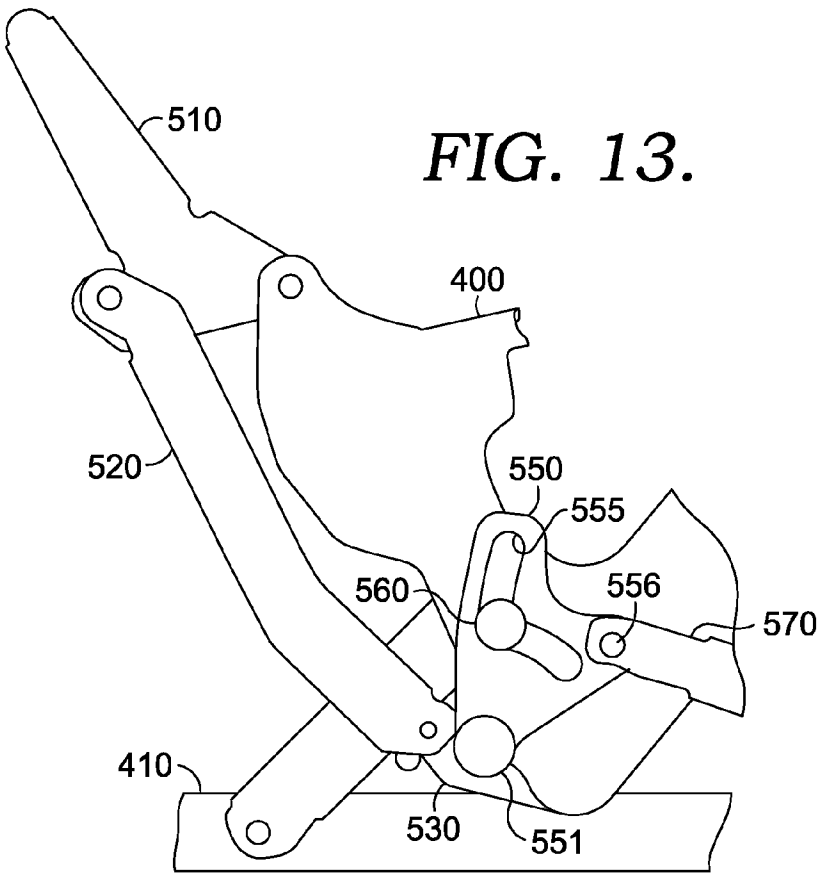
FIG. 13 is a view similar to FIG. 12, but in the extended position, in accordance with an embodiment of the present invention.
Figure 12:
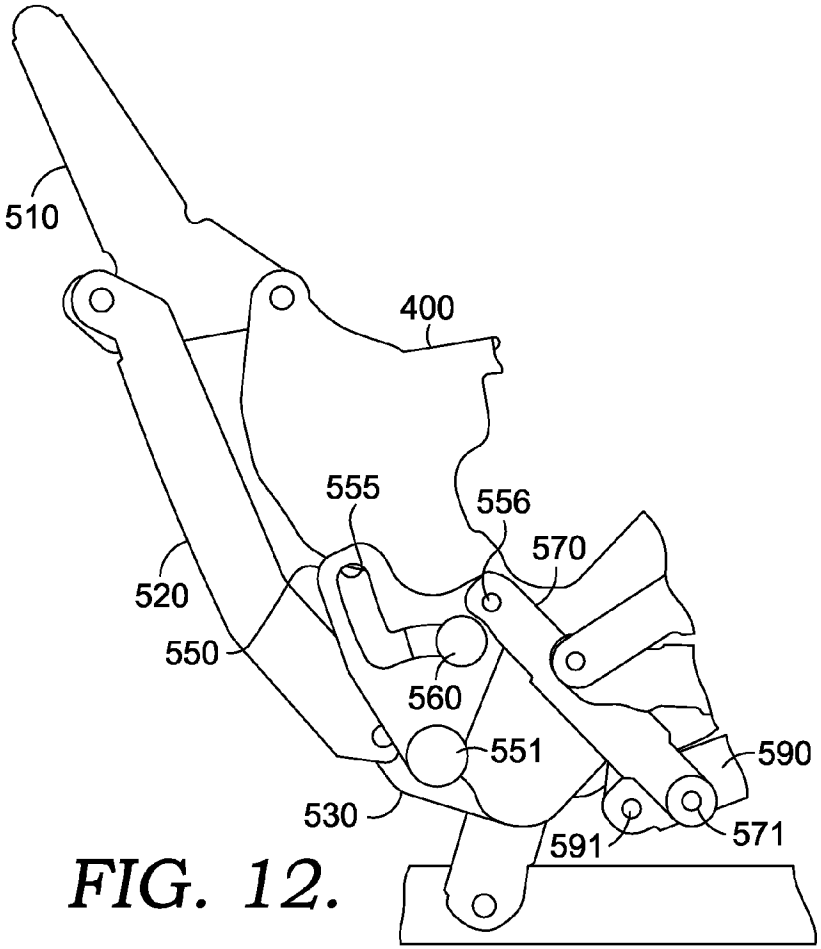
FIG. 12 is a partial side-elevation view of the linkage mechanism in the closed position highlighting a sequence plate, in accordance with an embodiment of the present invention.

Typically, the activator bar 350 is adapted to receive an occupant's actuation of adjustment between the closed position and the extended position. In particular embodiments, the activator bar 350 may be manually controlled (e.g., occupant may exert a manual rearward force on a hand-lever or may exert a force on a release lever of a cable actuator) or automatically controlled (e.g., occupant may trigger a control signal transmitted to a linear actuator 300), as more fully discussed below with reference to FIGS. 8A-8D and **18*a*-18D. Activator bar 350 is fixedly attached to the activator bracket 360 at an upper end thereof (FIG. 11). A lower end of the activator bracket 360 is pivotably coupled, at pivot 365, to a rearward portion 372 of the footrest lock link 370, as best depicted in FIG. 11**.

With reference to a manual-operated embodiment of the present invention, the inter-coupling of activator bracket 360 and the footrest lock link 370 converts a torque exerted by the occupant (rotational force) applied to the activator bar 350, into a forward and upward push (directional force) that acts on the pivot 111 of the footrest assembly 200. That is, a counterclockwise moment applied to the activator bar 350, with reference to FIG. 11, is transferred into an upward and forward translation of the footrest lock link 370 that initiates extension of the footrest assembly 200 from the closed position (FIGS. 1 and 7) to the extended position (FIGS. 2 and 6).

As discussed above, the pivot 111 couples a forward portion 371 of the footrest lock link 370 to the front ottoman link 110 of the footrest assembly 200. Unlike traditional 4-bar extension mechanisms, the upward and forward push is directed to the front ottoman link 110, as opposed to a rear ottoman link. Thus, the configuration of FIGS. 4-7 enables a significant extension of the footrest assembly 200, but also, a compact collapsed size of the footrest assembly 200 when in the closed position. This compact collapsed size enables the footrest assembly 200 to be located below the seating support surface and above a lower surface of at least one crossbeam (discussed below) when in the closed position.

In operation, upon applying the forward and upward push (via the footrest lock link 370) that acts on the pivot 111, the front ottoman link 110 is rotated forward about the pivot 115 causing the footrest assembly 200 to extend. The forward rotation of the front ottoman link 110 affects forward rotation of the rear ottoman link 120 about the pivot 121. Generally, as a result of the configuration of the pivots 133 and 113, the front ottoman link 110 and the rear ottoman link 120 rotate in substantial parallel-spaced relation. The rotation of the front ottoman link 110 and the rear ottoman link 120 generate upward movement of the outer ottoman link 150 and the inner ottoman link 130, respectively. During their upward movements, the outer and inner ottoman links 150 and 130, respectively, operate in conjunction to raise and rotate the mid-ottoman bracket 140 and the footrest bracket 170 to generally horizontal orientations. Accordingly, the first foot-support ottoman 16 (see FIGS. 1-3), supported by the footrest bracket 170, and the second foot-support ottoman 18, supported by the mid-ottoman bracket 140, are movable from positions below the seat support surface to extended, horizontally-orientated positions. Retraction of the footrest assembly 200 is triggered by a clockwise moment at the activator bar 350 (at the position depicted in FIG. 11) that pulls the footrest lock link 370 in a downward and rearward translation. Generally, this downward and rearward translation invokes movement of the footrest mechanism 200 that is reverse to the steps discussed above with reference to the extension operation.

Turning to FIGS. 5-7, the additional components of the seat-mounting assembly 500 will now be discussed. Beginning at a rearward point of the seat-mounting assembly 500, the back-mounting link 510 is rotatably coupled to a rear portion 902 (see FIG. 9) of the seat-mounting plate 400 at pivot 401. In addition, the back-mounting link 510 is pivotably coupled to an upper portion 521 of the rear control link 520 at pivot 511. Rear control link 520 is pivotably coupled at the upper portion 521 to the back-mounting link 510 at the pivot 511 and is pivotably coupled at a lower portion 522 to the rear bellcrank 530 at pivot 525.

Rear bellcrank 530 includes an upper portion 539, a lower portion 537, and a forward portion 538. Rear bellcrank 530 is rotatably coupled at the lower portion 537 thereof to a mid portion 409 (see FIG. 9) of the seat-mounting plate 400 at pivot 536. Further, the rear bellcrank 530 is pivotably coupled at the lower portion 537 to the lower portion 522 of the rear control link 520 at pivot 525. In addition, the rear bellcrank 530 is pivotably coupled at the upper portion 539 to an upper portion 543 of the rear pivot link 540 at pivot 541. A lower portion 544 of the rear pivot link 540 is rotatably coupled to a back end 416 of the base plate 410 at pivot 542. Generally, this inter-coupling of the rear control link 520, the rear pivot link 540, and the rear bellcrank 530 is adapted to translate the seat-mounting plate 400 over the base plate 410 during adjustment between the closed position, the extended position, and the reclined position while maintaining the inclined orientation relationship therebetween. In an exemplary embodiment, the seat-mounting plate 400 may be biased at a substantially consistent inclination angle with respect to the base plate 410 throughout the adjustment between the closed position, the extended position, and the reclined position. Further, the inter-coupling of the rear control link 520, the rear pivot link 540, and the rear bellcrank 530 is adapted to recline the backrest 14 (see FIGS. 1-3) rearward while translating the seat-mounting plate 400 upward and forward over the base plate 410. Accordingly, the zero-wall clearance capability is achieved.

Rear bellcrank 530 includes a rear stop element 420 (FIGS. 6 and 7) to prevent additional inclination of the back-mounting link 510 when the rear pivot link 540 makes contact therewith, as depicted in FIG. 7. As such, the location of the rear stop element 420 on the rear bellcrank 530 at least partially determines the extent of rearward bias allowed for the backrest and defines the configuration of the linkage mechanism 100 when adjusted to the closed position. Rear bellcrank 530 is also pivotably coupled at the forward portion 538 to a rearward portion 532 of the bridge link 535 at pivot 533. Bridge link 535 is pivotably coupled at a forward portion 531 to a mid portion 447 of the front lift link 440 at pivot 436.

In another embodiment, a stop element 513 extends from the seat-mounting plate 400. When in an upright position (e.g., FIG. 7) or a TV position (e.g., FIG. 6), the stop element 513 engages a portion of the back-mounting link 510, such as a side or an edge, to impede further forward inclination of the back-mounting link 510. For example, the back-mounting link 510 might include an extension or a finger 515 that extends from the back-mounting link 510 and that contacts the stop element 513. In addition, when moving to a fully reclined position (e.g., FIG. 5), the stop element 513 engages another portion of the back-mounting link 510 to impede further rearward recline of the back-mounting link. For example, the back-mounting link 510 might include a catch 517 that generally opposes the finger 515 and that engages the stop element 513. In one embodiment, the stop element 513 (e.g., pivot) engages at least two different portions of the back-mounting link 510, and each portion of the at least two different portions includes a respective edge. In a further embodiment, the respective edges extend along planes that intersect, such as indicated by dashed lines in the blown-up portion of FIG. 5. For example, the planes might intersect at an orientation that is near perpendicular.

Positioning the stop element 513 to engage the back-mounting link 510 in the fully upright and fully reclined positions serves various purposes. For example, absent the stop element 513 forward rotation of the back-mounting link is possible, even when the linkage mechanism is in an upright position, based on clearances in the multiple rivet joints between the rear pivot link 540 and the back mounting link 510. The stop 513 is located in relation to the back mounting link 510 to create a preload that further limits the movement of the back mounting link 510 forward. This also provides a more consistent alignment of the backs in multiple seat furniture such as three-seat sofas and sectionals. In the full recline position the position of the stop element 513, which engages the back-mounting link 510, also helps to prevent bending of the back mounting link 510 and rear pivot link 540. That is, absent the stop element 513, bending is a risk when a sufficiently large force (e.g., by an individual in the chair) is rearwardly applied on the chair back. To counter this risk, the back mounting link 510 could be made from heavier steel. However, by locating the stop element 513 on the seat plate 400 and at the back mounting link 510, the back mounting link 510 can be made from thinner steel to reduce cost.

In FIG. 5, the finger 515 and the catch 517 are merely exemplary and the back-mounting link 510 might include various other configurations designed to contact the stop element 513 at different points to control incline and recline of the back-mounting link 510. For example, instead of creating elements that protrude from a periphery of the back-mounting link 510, a cutout might be formed in the periphery to create a first engaging edge similar to the finger 515 and a second engaging edge similar to the catch 517. That is, the back-mounting link 510 includes a periphery and a body portion 509, and a cutout might extend inward from the periphery into the body portion 509.

In one embodiment, the portion of the back-mounting link 510 that engages the stop element 513 is configured to limit the amount of recline to approximately 49 degrees, relative to the upright position. For example, a distance between the finger 515 (i.e., first engaging edge) and the catch 517 (i.e., second engaging edge) creates a space, which defines a path of travel of the stop element 513 when the back-mounting link 510 pivots. The path of travel is configurable to control the amount of recline allowed. In an embodiment of the present invention, the distance of travel of the stop 513 is in a range between about 0.80" and about 1.20" when an about 0.450" diameter stop is used. As such, the configuration might also be a ratio of this distance and diameter. The stop element 513 might be used alone, or in combination with other stops described herein, to limit a range of motion of the linkage mechanism.

In embodiments, the front lift link 440 includes a rearward portion 446, a forward portion 445, and the mid portion 447. As discussed above, the mid portion 447 of the front lift link 440 is pivotably coupled to the forward portion 531 of the bridge link 535 at pivot 436. Front lift link 440 is rotatably coupled at the rearward portion 446 to a forward portion 901 (see FIG. 9) of the seat-mounting plate at pivot 441. Additionally, the front lift link 440 is pivotably coupled at the forward portion 445 to an upper portion 456 of the front pivot link 450 at pivot 452. The front pivot link 450 is rotatably coupled at a lower portion 457 to a front end 415 (see FIG. 9) of the base plate 410 at pivot 453.

In instances of the present invention, the front pivot link 450 includes a mid portion 458 that is pivotably coupled to a lower portion 463 of the carrier link 460 at pivot 451. The carrier link 460 is pivotably coupled at an upper portion 464 to the front bellcrank 485 at pivot 461. Typically, the front bellcrank 485 includes an upper portion 481, a lower portion 483, and a mid portion 482, as illustrated at FIG. 7. The upper portion 481 of the front bellcrank 485 is pivotably coupled to the carrier link 460 at pivot 461, as discussed immediately above. Pivot 487 at the mid portion 482 of the front bellcrank 485 rotatably couples the front bellcrank 485 to the mid portion 409 (see FIG. 9) of the seat-mounting plate 400. The lower portion 483 of the front bellcrank 485 is pivotably coupled to a back end 591 of the footrest drive link 590 at pivot 486. A front end 592 of the footrest drive link 590 is pivotably coupled to the rear ottoman link 120 of the footrest assembly 200 at the pivot 125.

With continued reference to FIGS. 4-7, the operation of the seat-adjustment assembly 500 will be discussed, in accordance with an embodiment of the present invention. Initially, an operator-initiated, rearward occupant force may be received at the backrest. As discussed above, the back-mounting link 510, in cooperation with a complimentary back-mounting link of the mirror-image linkage mechanism, serve to support the backrest of the seating unit. In one embodiment of a manually adjustable seating unit, the occupant's rearward force directed at the backrest should overcome a balance threshold in order to rearwardly bias the back-mounting link 510, thereby enabling movement from the extended position (FIG. 6) to the reclined position (FIG. 5). Essentially, the balance threshold may be defined by a ratio of the rearward occupant force on the backrest and the downward occupant weight on the seat. In operation, the downward force of the occupant's weight pushes the seat-mounting plate 400 downward, while the occupant's rearward force on the backrest pushes the seat-mounting plate 400 upward and forward via the inter-coupling of the back-mounting link 510, the rear control link 520, the rear bellcrank 530, the rear pivot link 540, and the base plate 410. (It should be noted that the balance threshold is applicable in a manual-adjustment style seating unit, while an automated-adjustment style seating unit relies on a motor or other linear actuator to adjust the linkage mechanism 100 between the extended and reclined positions.) As such, the rearward force competes against the downward force to invoke adjustment of the seating unit.

Once the occupant overcomes the balance threshold by counteracting his/her weight in the seat by exerting sufficient rearward force, or leaning backward on the backrest, rearward rotation of the back-mounting link 510 (clockwise rotation from the perspective of FIG. 5) is enabled about the pivot 401 and adjustment from the extended position to the reclined position commences. The rearward rotation generates a torque about the pivot 511. The torque is converted to a laterally-directed force through the rear control link 520. Consequently, the rear control link 520 transfers the laterally-directed force between the back-mounting link 510 and the rear bellcrank 530. Typically, the rear control link 520 creates a clockwise torque on the rear bellcrank 530 about the pivot 536. Rear bellcrank 530 converts the clockwise torque to a downward force directed through the rear pivot link 540, which rotates about the back end 416 of the base plate 410 at pivot 542.

This rotation enables the seat-mounting plate 400 to be translated forward and upward in relation to the base plate 410 during adjustment from the extended position to the reclined position. In embodiments, the links 510, 520, and 540, as well as the rear bellcrank 530, are designed to translate the seat-mounting plate 400 such that the seat remains biased in a substantially consistent inclination angle with respect to the base plate 410 when adjusting from the TV position to the full-recline position. Further, the links 510, 520, and 540, as well as the rear bellcrank 530, are designed to translate the seat-mounting plate 400 forward at a greater rate than the rearward rotation of the back-mounting link 510, thus, achieving zero-wall clearance.

The forward translation of the seat-mounting plate 400 is additionally affected by the links 535, 440, and 450. In a particular embodiment, the clockwise torque (imposed by the occupant) on the rear bellcrank 530 about the pivot 536 generates a laterally-directed force on the bridge link 535 that acts to pull the front lift link 440 rearward. This rearward pull creates a counterclockwise rotation of the front lift link 440 about the pivot 441, which rotatably couples the front lift link 440 to the seat-mounting-plate 400. This counterclockwise rotation is eventually impeded by an interior mid stop element 421. When the front lift link 440 contacts the interior mid stop element 421, full adjustment to the reclined position is achieved. The counterclockwise rotation of the front lift link 440 also creates a laterally-directed force through the front pivot link 450 onto the front end 415 of the base plate 410. The laterally-directed force causes the front pivot link 450 to swing forward about pivot 453, thereby enabling forward translation of the seat-mounting plate 400 with respect to the base plate 410.

Upon relieving the rearward occupant force on the backrest below the balance threshold (e.g., by the occupant leaning forward), the back-mounting link 510 is allowed to forwardly bias. In particular, the downward occupant weight allows the rear pivot link 540 to push upward on the rear bellcrank 530 creating counterclockwise rotation thereof.

The counterclockwise rotation transfers a laterally-directed force through the rear control link 520 that acts to rotate the back-mounting link 510 in a counterclockwise manner. That is, the laterally-directed force applied by the rear control link 520 enables moving the back-mounting link 510 forward to a substantially upright orientation. In one instance, a stop element (not shown) extending from the rear bellcrank 530 resists continued rotation thereof, upon contacting the seat-mounting plate 400; thus, further forward inclination of the backrest when in the closed or the extended position is contained.

Figure 17A:
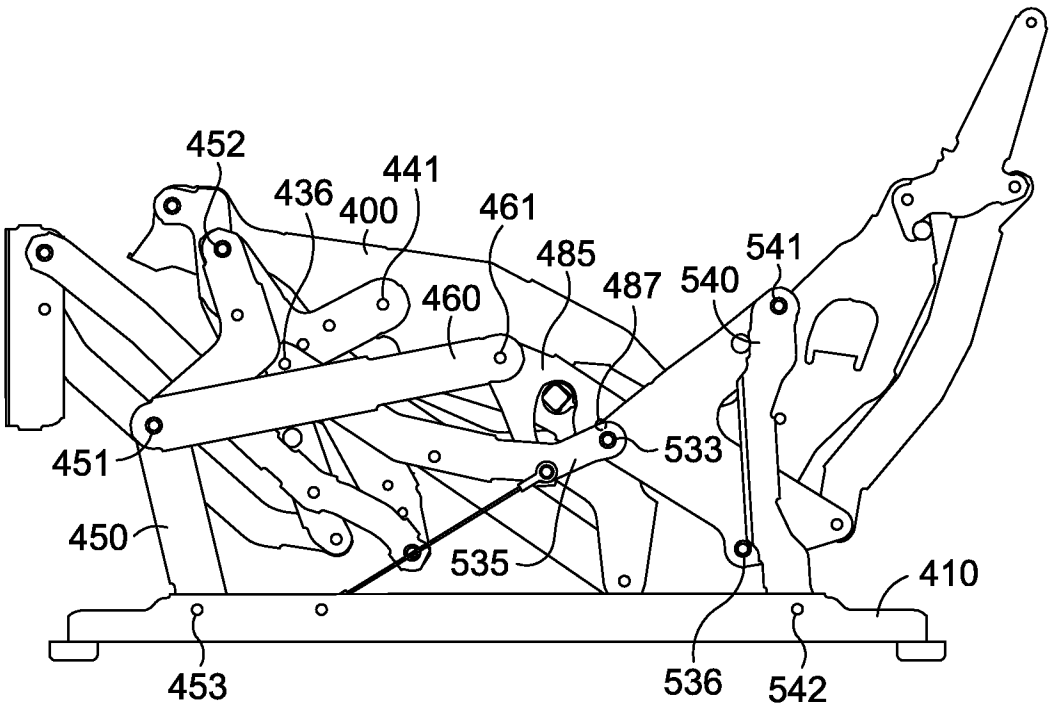
FIGS. 17A-17C show a linkage mechanism having components similar to FIGS. 4-7 with different geometries, in accordance with an embodiment of the present invention.
Figure 17B:
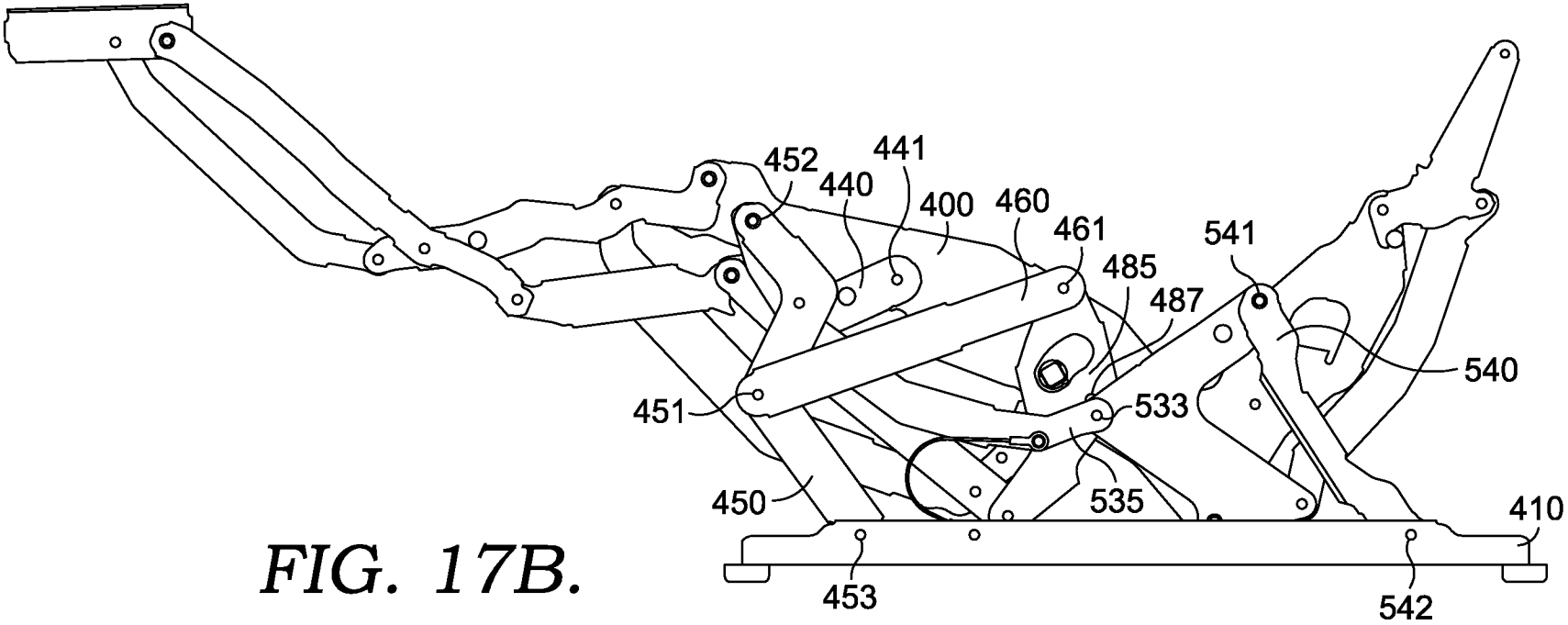
Figure 17C:
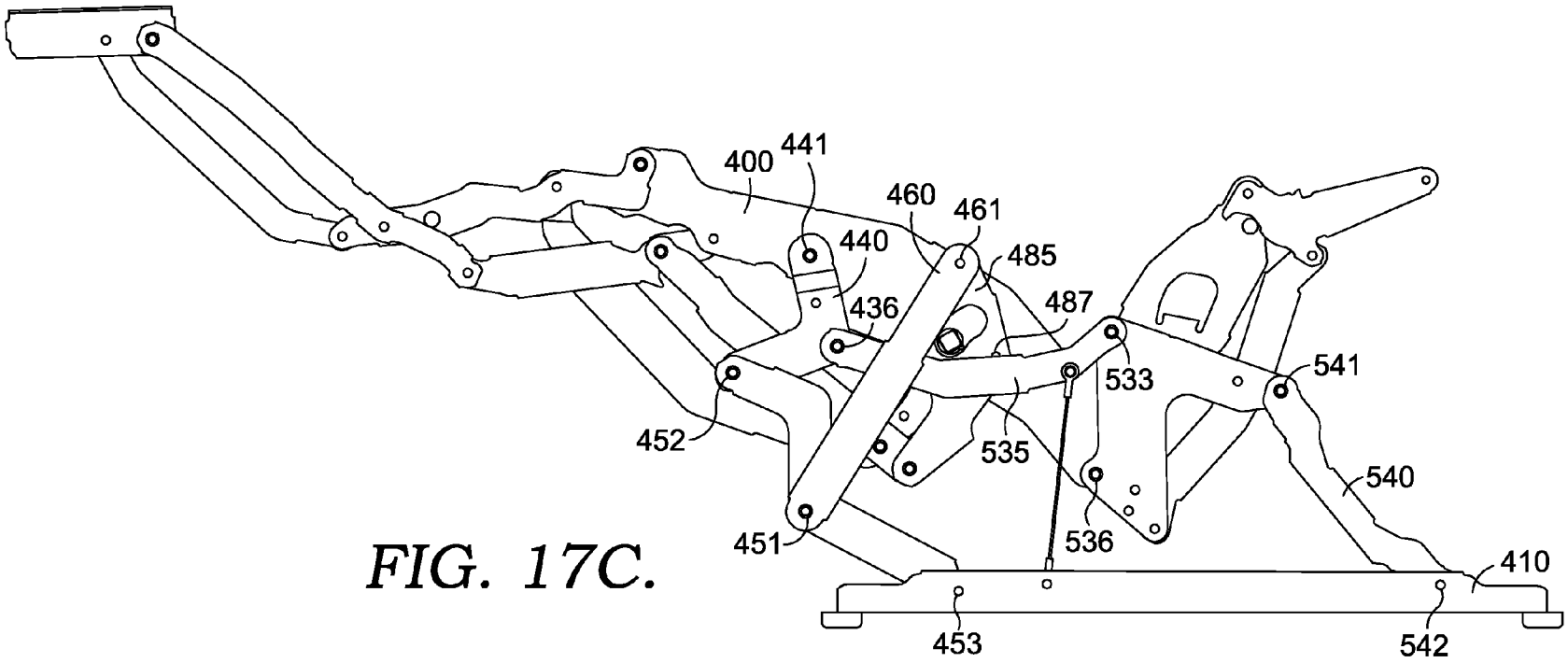

As previously indicated, in accordance with an embodiment of the present invention, the dimensions and geometries of the various links and pivots are variable, which allows the linkage mechanism 100 to be configured to achieve desired functionality. The various links and pivots are configurable to control an amount of forward and upward translation of the seat-mounting plate 400 relative to the base plate 410. An example of an embodiment in which the linkages of the linkage mechanism 100 have different dimensions is depicted by FIGS. 17A-17C. Examples of dimensions that might be varied include a distance between the pivot 542 and the pivot 453 of the base plate 410; a distance between the pivots 541 and 542 of the rear pivot link 540; a distance between the pivots 452 and 453 of the front pivot link 450; a distance between the pivots 533 and 436 of the bridge link 535; a distance between the pivots 451 and 461 of the front control link 460; and a shape of the front bell crank 485.

In an embodiment of the present invention, the distance between the pivots 541 and 542 of the rear pivot link 540 and between the pivots 452 and 453 of the front pivot link 450 affects forward translation of the seat-mounting plate 400 relative to the base plate. For example, increasing the distance between the pivots 541 and 542 and increasing the distance between the pivots 452 and 453 contributes to an increased forward translation of the seat-mounting plate 400, which improves zero-wall features (e.g., wall clearance) of the linkage mechanism. Decreasing the distances between these pivots contributes to an improved seat clearance to the linkage.

In an embodiment of the present invention, the distance between the pivots 541 and 542 is in a range from about 7 inches to about 8.6 inches, and preferably from about 7.3 inches to about 8.6 inches. For example, in one embodiment, to create a desired amount of forward translation of the seat-mounting plate 400, the distance between the pivots 541 and 542 is about 8.6 inches, and more specifically is about 8.573 inches (e.g., FIGS. 17A-17C). In another embodiment, to create a desired amount of seat clearance, the distance between the pivots 541 and 542 is about 7.3 inches, and more specifically is about 7.328 inches (e.g., FIGS. 4-7). In a further embodiment of the present invention, the distance between the pivots 452 and 453 is in a range from about 8.5 inches to about 10 inches, and preferably from about 8.7 inches to about 9.8 inches. For example, in one embodiment, to create a desired amount of forward translation of the seat-mounting plate 400, the distance between the pivots 541 and 542 is about 9.8 inches, and more specifically is about 9.804 inches (e.g., FIGS. 17A-17C). In another embodiment, to create a desired amount of seat clearance, the distance between the pivots 541 and 542 is about 8.7 inches, and more specifically is about 8.714 inches (e.g., FIGS. 4-7).

Distances between pivots might be defined as ratios of one another. For example, if some or all of the linkage mechanism 100 were increased or decreased in size by a factor then ratios could be used to determine the appropriate distances between pivots. As such, in one embodiment of the present invention, the ratio of the distances between the pivots 541 and 542 and the pivots 452 and 453 is about 8.6:9.8, which creates a desired amount of forward translation of the seat-mounting plate (e.g., FIGS. 17A-17C). In another embodiment of the present invention, the ratio of the distances between the pivots 541 and 542 and the pivots 452 and 453 is about 7.3:8.7, which creates a desired amount of seat clearance (e.g., FIGS. 4-7).

In another embodiment of the present invention, relative positions of the front pivot link 450, the front lift link 440, and the front bell crank 485 are shifted forward relative to other elements of the linkage mechanism 100. For example, the pivot 453 of the front pivot link 450 might be arranged further forward on base plate 410, such that the distance between the pivot 542 and the pivot 453 is increased and the pivot 453 is shifted further towards a front portion of the base plate 410. In addition, the pivot 441 at which the front lift link 440 attaches to the seat-mounting plate 400 is shifted forward, as well as the pivot 487 at which the front bell crank 485 attaches to the seat-mounting plate 400.

When constructing the linkage mechanism, shifting the front pivot link 450, the front lift link 440, and the front bell crank 485 forward, in combination with other elements of the linkage mechanism 100, can contribute to higher upward translation of the seat plate 400 relative to the base 410. For example, a distance between the pivots 451 and 461 of the carrier link 460 affects upward translation of the seat plate 400 relative to the base plate 410. That is, increasing the distance between the pivots 451 and 461 contributes to an increased upward translation, which improves layout features of the linkage mechanism. Layout features are improved because the seat and chair are moving at a greater rate to balance seat back recline.

In an embodiment of the present invention, the distance between the pivots 451 and 461 is in a range from about 8 inches to about 8.6 inches. For example, in one embodiment, the distance between the pivots 451 and 461 is about 8.1 inches and more specifically is about 8.077 inches (e.g., FIGS. 4-7). In another embodiment, to increase upward translation of the seat-mounting plate 400, the distance between the pivots 451 and 461 is about 8.5 inches and more specifically is about 8.535 inches (e.g., FIGS. 17A-17C). As such, an embodiment of the present invention depicted in FIGS. 17A-17C includes shifting (relative to the embodiment depicted in FIGS. 4-7) the front pivot link 450, the front lift link 440, and the front bell crank 485 forward (relative to the seat-mounting plate 400) and configuring the distance between the pivots 451 and 461 to be about 8.5 inches.

Shifting the front pivot link 450, the front lift link 440, and the front bell crank 485 forward might be defined in various manners. For example, the pivot 487 might attach the front bell crank 485 to the seat-mounting plate 400 at various positions. In a first configuration, a distance of about 4 inches might extend between the pivot 487 and 536 (e.g., FIGS. 4-7). In a second configuration (e.g., FIGS. 17A-17C) in which the front bell crank 485 is shifted forward, a distance of about 4.5 inches might exist between the pivot 487 of the front bell crank 485 and pivot 536, such that the pivot 487 is shifted forward by about 0.9 inches horizontally as compared to the first configuration.

In the embodiment depicted in FIGS. 4-7, the front bell crank 485 includes a cane-like configuration, which allows the front bell crank 485 to rotate around the activator bar 350. That is, the curve of the front bell crank 485 allows the front bell crank 485 to rotate when moving from a closed position (e.g., FIG. 7) to an extended position (e.g., FIG. 6) without colliding with the drive 350. However, the curve of the front bell crank 485 could be configured differently when the front bell crank 485 is shifted forward to avoid interference with the activator bar 350. For example, a slot might be positioned in a periphery of the front bell crank 485 or in a middle portion of the front bell crank 485 (e.g., FIGS. 17B and 17C), the slot providing a travel path for the activator bar 350 when the front bell crank rotates around the activator bar 350.

Referring now to FIGS. 8A-8D and 18A-18D, an automated version of the linkage mechanism 100 is illustrated, and will now be described via the embodiments below. In one embodiment, the automated version includes a double linkage configuration as depicted in FIGS. 8A-8D. In an alternative embodiment, the automated version includes a single-drive-link configuration as depicted in FIGS. 18A-18D.

Referring now to FIGS. 8A-8D, the automated version may involve a linear actuator 300 that includes an angle bracket 315 fixed to the activator bar 350 (discussed above), a motor mechanism 320, and a track 330 that interconnects the motor mechanism 320 and a motor activator block 340. In addition, the linear actuator might include a right motor link 380 and a left motor link 390, which reside in a substantially parallel-spaced relation to one another. Further, a support assembly 600 may be provided that serves as a foundation that rests on a surface underlying the seating unit.

Figure 15:
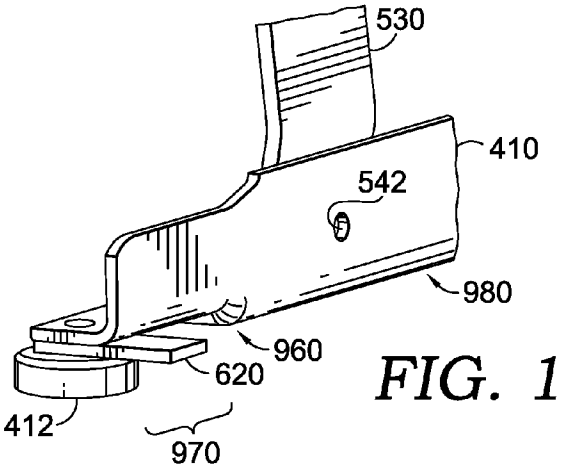
FIG. 15 is a diagrammatic perspective view of a based plate exhibiting a formed step on one end, in accordance with an embodiment of the present invention.
Figure 14:
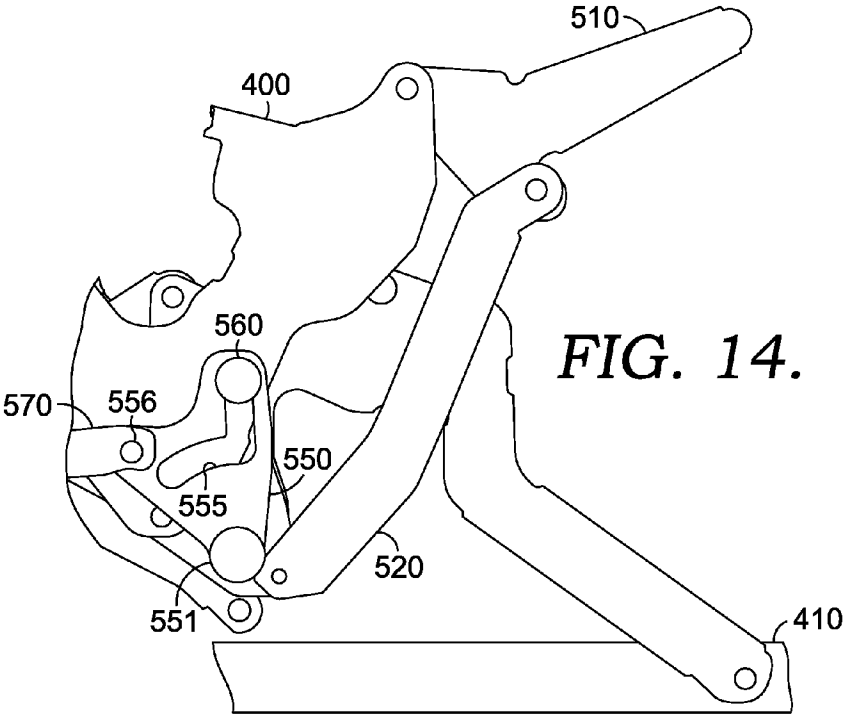
FIG. 14 is a view similar to FIG. 12, but in the reclined position, in accordance with an embodiment of the present invention.

In particular, the support assembly 600 may serve to accommodate the linear actuator 300. The support assembly 600 depicted in FIG. 8A includes a front lateral member 610 and a rear lateral member 620, which resides in substantially parallel-spaced relation to the front lateral member 610. The lateral members 610 and 620 function to support the linear actuator 300 and the base plates 410 above an underlying surface. The support bushings 411 and 412 of FIGS. 5 and 15 are provided to raise the linear actuator 300, and the base plates 410, to a specific level above the underlying surface.

In embodiments, the lateral members 610 and 620 function as crossbeams that span between the base plate 410 of the linkage mechanism 100 and a complimentary base plate incorporated within a mirror-image linkage mechanism that is disposed in substantial parallel-spaced relation to the linkage mechanism 100. Further, the lateral members 610 and 620 may be formed from metal stock. Similarly, the seat-mounting plate 400, base plate 410, and the plurality of links that comprise the linkage mechanism 100 are typically formed from metal stock, such as stamped, formed steel. However, it should be understood and appreciated that any suitable rigid or sturdy material known in the furniture-manufacturing industry may be used in place of the materials described above.

In embodiments of the linear actuator 300, the motor mechanism 320 is protected by a housing that is coupled, or fixedly attached, to the front lateral member 610. The motor mechanism 320 is operably coupled to a forward end of the track 330. A rearward end of the track 330 is coupled, or fixedly attached, to the rear lateral member 620. The track 330 includes a first travel section 331 and a second travel section 332. The motor activator block 340 is configured to translate longitudinally, or slidably engaged, along the track 330 under automated control of the motor mechanism 320. Right motor link 380 and the left motor link 390 are pivotably coupled to the motor activator block 340, and are pivotably coupled to angle brackets 383 and 393 (respectively) extending from the angle bracket 315, by way of pivots 382 and 392.

As discussed above, the linkage mechanism 100 is coupled to the linear actuator 300, which provides powered adjustment of the linkage mechanism 100 between the reclined, the extended, and the closed positions. In an exemplary embodiment, the motor activator block 340 travels towards or away from the motor mechanism 320 along the track 330 during automated adjustment of the linkage mechanism 100. In a particular embodiment, the motor mechanism 320 controls movement of the motor activator block 340 along the travel sections 331 and 332 of the track 330.

In operation, a control signal from the occupant of the seating unit, or elsewhere, may trigger the motor mechanism 320 to invoke longitudinal translation of the motor activator block 340, which, in turn, generates movement of the linkage mechanism 100. As more fully discussed below, the sliding action is sequenced into a first phase and a second phase. During the first phase, the motor mechanism 320 moves the motor activator block 340 forward with respect to the motor mechanism 320, while the motor mechanism 320 remains generally fixed in space, thereby adjusting the seat-adjustment assembly 500 from the closed position (FIGS. 7 and 8B) to the extended position (FIGS. 6 and 8C).

Adjustment within the first phase involves causing the motor activator block 340 to longitudinally traverse, or slide, along the first travel section 331 of the track 330. This traverse of the motor activator block 340 within the first travel section 331 generates a forward and upward thrust at the motor links 380 and 390 that pushes on the angle bracket 315, thereby rotatably adjusting the activator bar 350. That is, traversal of the motor activator block 340 toward the motor mechanism 320 within the first travel section 331 causes angle bracket 393 to rotate clockwise (based on the view provided by FIG. 8B) on pivot 392, thereby rotating angle bracket 315 and activator bar 350 clockwise. FIG. 8C provides an exemplary illustration of the configuration of the angle bracket 393, angle bracket 315, and activator bar 350 after the clockwise rotation from FIG. 8B. As discussed above, the rotatable adjustment of the activator bar 350 controls adjustment of the seating unit between the closed position and the extended position (i.e., extending the footrest assembly 200).

Once a stroke of the first phase is substantially complete, the second phase occurs. During the second phase, the motor activator block 340 moves forward again with respect to the motor mechanism 320, while the motor mechanism 320 remains generally fixed in space. In embodiments, adjustment within the second phase involves causing the motor activator block 340 to longitudinally traverse along the second travel section 332 of the track 330. Because the linkage mechanism is at full extension and the activator bar 350 is impeded from further rotation, this traverse of the motor activator block 340 within the second travel section 332 (and toward the motor mechanism 320) generates a forward and upward thrust at the motor links 380 and 390 that pushes on the angle bracket 315, thereby translating the activator bar 350 forward and upward with respected to the base plate 410. This translation of the activator bar 350 controls adjustment of the seating unit between the extended position and the reclined position (i.e., initiating adjustment of the seat-adjustment assembly 500 without the assistance of an occupant's rearward force on the backrest). For example, translation of the activator bar 350 forward and upward causes the seat plate 400 to also move forward and upward, which in turn causes the back mounting link 510 to rotate clockwise on pivot 401.

In one instance, the combination of the motor mechanism 320, the track 330, and the motor activator block 340 is embodied as the "electrically powered" linear actuator 300. In this instance, the linear actuator 300 is controlled by a hand-operated controller that provides instructions thereto. These instructions may be provided upon detecting a user-initiated actuation of the hand-operated controller. Further, these instructions may cause the linear actuator 300 to carry out a complete first phase and/or second phase of movement. Or, the instructions may cause the linear actuator 300 to partially complete the first phase or the second phase of movement. As such, the linear actuator 300 may be capable of being moved to and maintained at various positions within a stroke of the first phase or the second phase, in an independent manner.

Although a particular configuration of the combination of the motor mechanism 320, the track 330, and the motor activator block 340 has been described, it should be understood and appreciated that other types of suitable devices that provide sequenced adjustment may be used, and that embodiments of the present invention are not limited to the linear actuator 300 as described herein. For instance, the combination of the motor mechanism 320, the track 330, and the motor activator block 340 may be embodied as a telescoping apparatus that extends and retracts in a sequenced manner.

In another embodiment of the present invention, the automated version includes a single-drive-link configuration as depicted in FIGS. 18A-18D. The embodiment depicted in FIGS. 18A-18D is similar to FIGS. 8A-8D in that a motor 1818 is attached to a track 1820, and the motor attaches to a front lateral member 610 while an end of a track 1820 attaches to a rear lateral member 620. In addition, a motor activator block 1812 slidably attaches to the track 1820 such that the motor activator block 1812 is traversable along the track 1820 using the motor 1818 (or some other linear actuator). Generally, as the motor activator block 1812 traverses the track 1820, a drive link 1810 causes a seating unit to move between a collapsed, extended, and reclined position.

The embodiment depicted in FIGS. 18A-18D differs structurally from FIGS. 8A-8D in various respects. For example, the two drive links 380 and 390 (e.g., FIG. 8A) are replaced by a single drive link 1810 (e.g., FIG. 18A). In addition, in FIG. 18A-18D, a motor activator block 1812 is differently configured, as well as the angle brackets 1814 and 1816.

In an embodiment of the present invention, the motor activator block 1812 includes a carriage body 1822, which slidably couples the motor activator block 1812 to the track 1820. For example, the carriage body 1822 might include an aperture (not shown) through which the track 1820 extends when the motor activator block 1812 is slidably coupled to the track 1820. In addition, the motor activator block 1812 includes a pair of rearwardly extending mounting tabs 1824 and 1826, and each mounting tab includes a respective aperture.

The mounting tabs 1824 and 1826 include a space therebetween, and an end of the drive link 1810 fits into the space. The apertures of the mounting tabs 1824 and 1826 receive a single fastener, which also extends through a hole in the end of the drive link 1810 inserted into the space, to pivotably attach the drive link 1810 to the motor activator block 1812 at pivot 1828. Thus, the drive link 1810 is pivotably attached at one end by way of pivot 1828 to the motor activator block 1812. An opposing end of the drive link 1810 fits between the angle brackets 1814 and 1816 and is pivotably attached to the angle brackets 1814 and 1816 at pivot 1830 by a single fastener. Further, both angle brackets 1814 and 1816 are attached directly or indirectly to the activator bar 350. In one embodiment, the angle brackets 1814 and 1816 might be attached directly to the activator bar 350. In another embodiment, each angle bracket 1814 and 1816 might be attached to the angle bracket 315 with a respective single fastener, and the angle bracket 315 is coupled to the activator bar 350.

An operation of the linear actuator (e.g., motor 1818) and single drive link 1810 will now be described with respect to FIG. 18D, which depicts a phase diagram of the drive components at different stages. For example, FIG. 18D illustrates the drive components when the mechanism is adjusted between a closed position 1840, an extended position 1842, and a reclined position 1844.

Figure 18A:
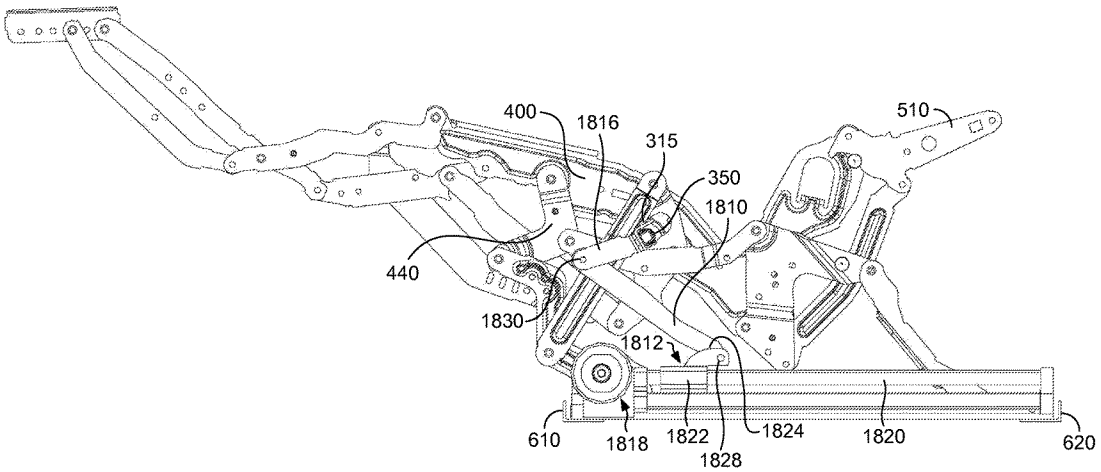
FIGS. 18A-18D show an alternative version of a linear actuator that includes a single drive link and that provides motorized adjustment of the seating unit, in accordance with an embodiment of the present invention.
Figure 18B:
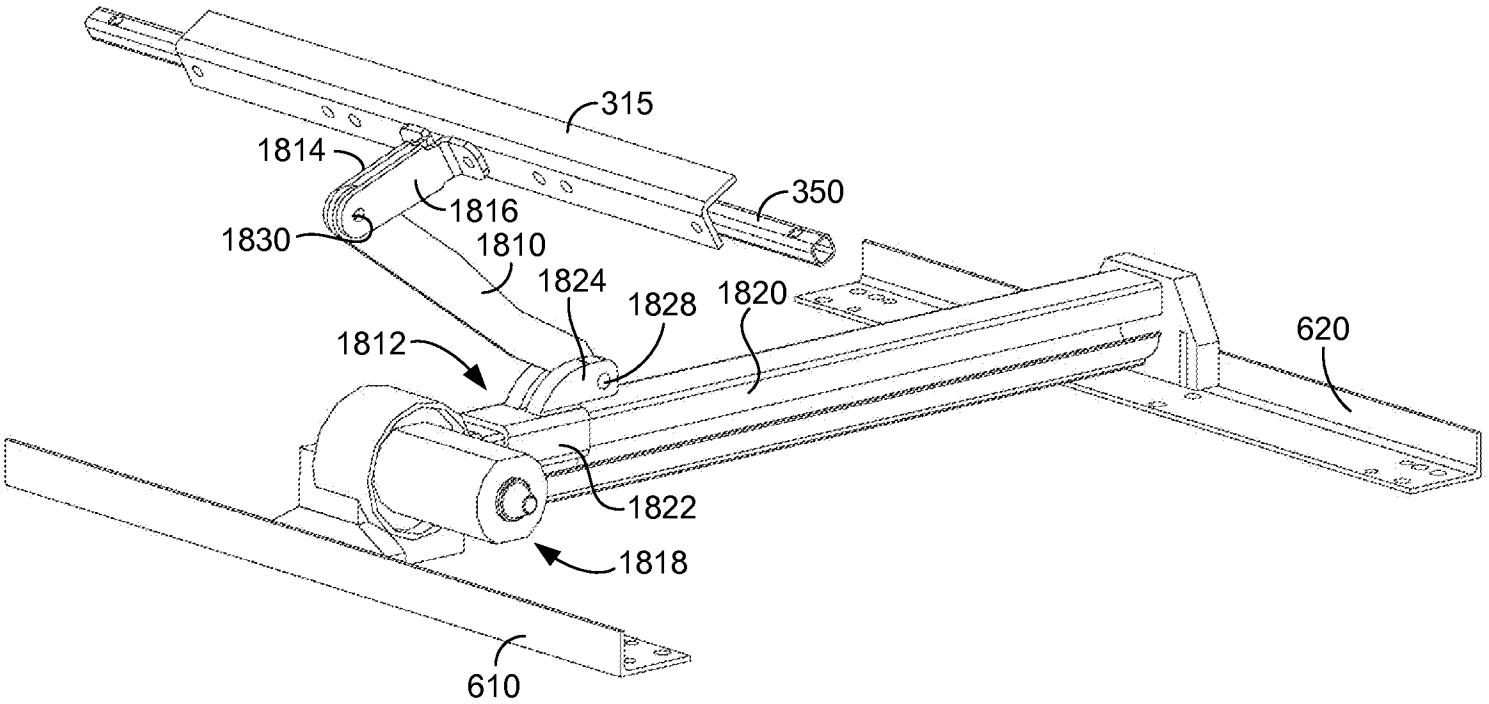
Figure 18C:
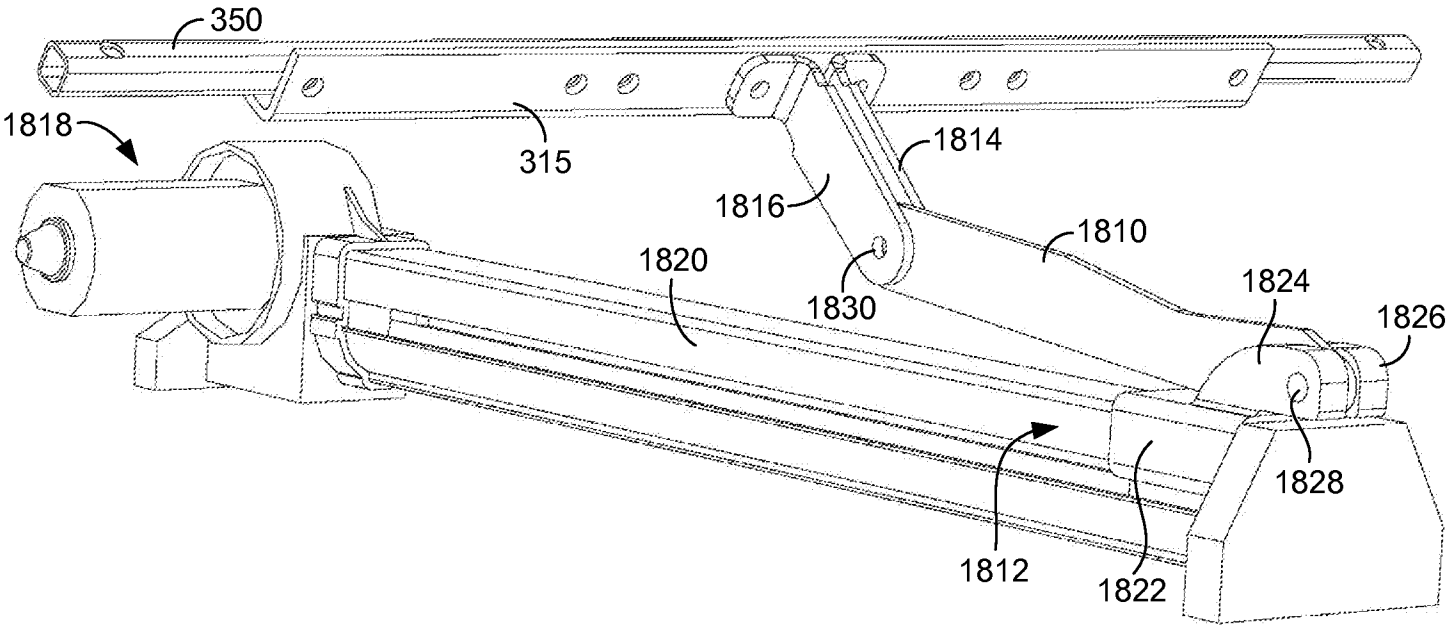
Figure 18D:
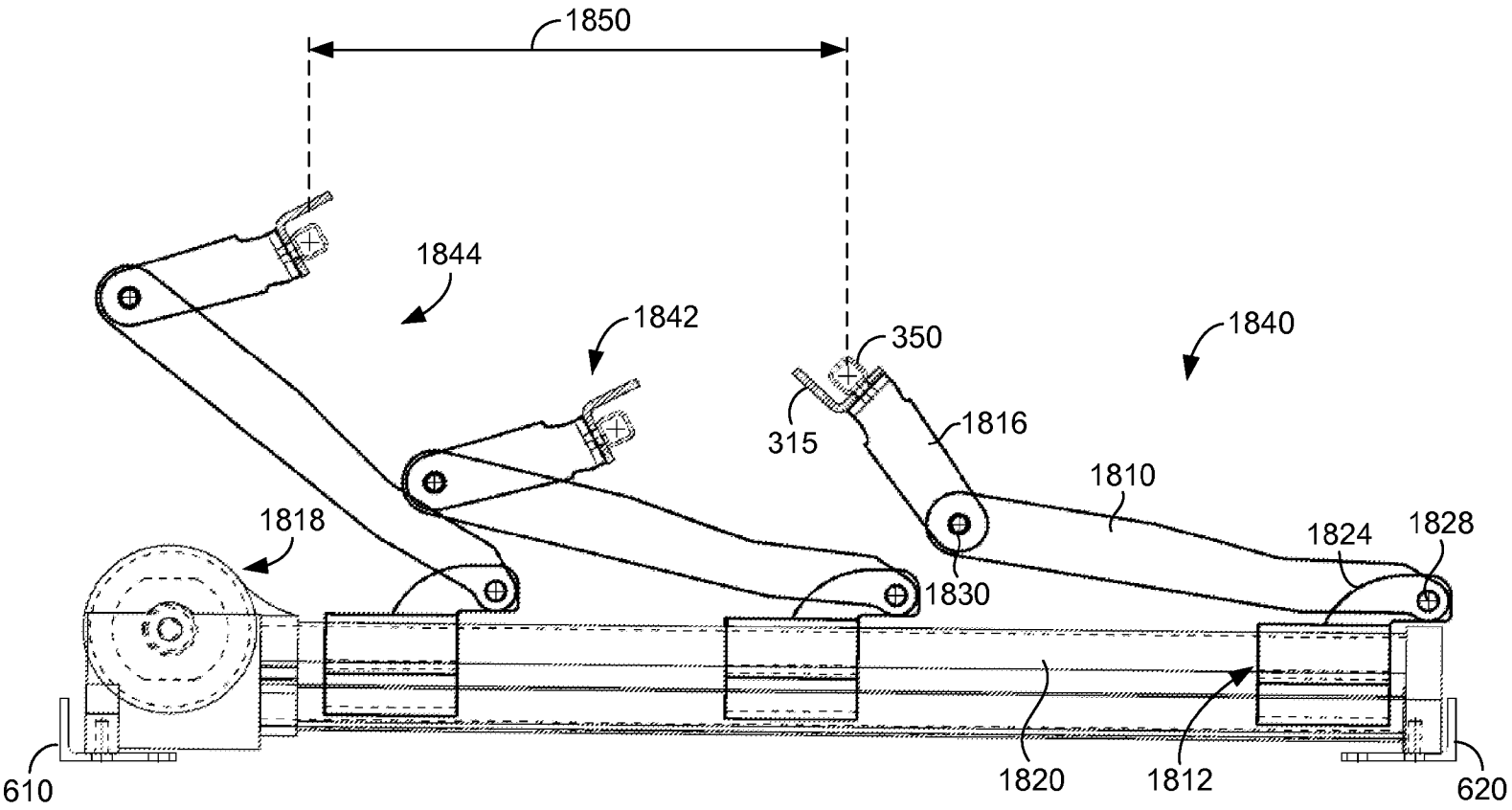

In a closed arrangement 1840, the motor 1818 biases the motor activator block 1812 rearwardly, thereby holding the mechanism in a closed position (e.g., FIGS. 1 and 7), and the drive link 1810 is in a generally horizontal orientation as viewed from the side in FIG. 18D. From the closed arrangement 1840, activation of the motor 1818 slides the motor activator block 1812 towards the motor 1818, thereby manipulating the mechanism to an extended arrangement 1842. The relatively horizontal orientation of the single drive link 1810 at least partially contributes to a forward driving force that is applied to pivot 1830 when the motor activator block 1812 is slid toward the motor 1818. That is, because the drive link 1810 retains its generally horizontal orientation, the forward force imparted by the motor activator block 1812 on the pivot 1818 is translated into a forward thrust by the drive link 1810 on the pivot 1830.

Pushing forward on pivot 1830 from the closed arrangement 1840 causes the angle brackets 1814 and 1816 to pivot clockwise on pivot 1830 (based on the view provided in FIG. 18D), thereby causing clockwise rotation of the activator tube 350. As described in other parts of this description, the clockwise rotation of the activator tube 350 causes extension of the footrest assembly. The extension of the footrest assembly is limited in part by stop element 422 (FIG. 4), such that engagement of stop element 422 by link 130 impedes further rotation of activator tube 350.

In an embodiment of the present invention, the drive tube 350 rotates by a threshold degree amount in order to adjust a seating unit from a standard position (e.g., 1840) into a TV position (e.g., 1842). For example, in one embodiment, the drive tube 350 rotates by at least about 104 degrees when adjusting from a collapsed arrangement 1840 to an extended position 1842. In another embodiment, the drive tube 350 rotates by an amount that is in the range of about 104 degrees to about 104.815 degrees. Inherently, when the threshold degree amount is near constant (i.e., about 104 degrees), the operation of the linkage mechanism is adjustable by adjusting the length of angle brackets 1814 and 1816.

From the extended arrangement 1842, activation of the motor 1818 slides the motor activator block 1812 towards the motor 1818 and into a reclined arrangement 1844. Again, the drive link 1820 is in a generally horizontal orientation at position 1842, such that the force imparted onto pivot 1828 by motor activator block 1812 translates into a partially forward drive on pivot 1830, angle brackets 1814 and 1816, and activator tube 350. Because the activator tube 350 is impeded from further rotation in the reclined arrangement 1844, movement of the drive link 1810 forward "drags" the angle brackets 1814 and 1816 forward, together with the actuator tube 350. Imparting force forward on pivot 1830 from the extended arrangement 1842 imparts a forward force on the activator tube 350. Referring also to FIG. 18A, the forward force on the activator tube 350 is translated to the seat plate 400, thereby causing the back mounting link 510 to rotate rearwardly and in a clockwise direction relative to the seat plate. In FIG. 18D, it can be seen that the activator tube 350 translates slightly upward from the extended position 1842 to the reclined position 1844, which is directed in part by the front lift link 440.

In accordance with an embodiment of the present invention, the mounting tabs 1824 and 1826 rearwardly extend from the carriage body 1822, in a direction towards a back of the seating unit and towards rear lateral member 620. Extending the mounting tabs 1824 and 1826 in a rearward direction (as opposed to extension towards a front of the seating unit and in a direction towards front lateral member 610) positions the apertures (i.e., pivot 1828) further rearward, thereby allowing the drive link 1810 to have a longer length between pivot 1828 and pivot 1830. In addition, extending the mounting tabs 1824 and 1826 towards a rear portion of the seating unit (as opposed to towards a front of the seating unit) increases distance traveled by the motor activator block 1812, thereby increasing the stroke length of the linkage mechanism.

In embodiments of the present invention, the length of the drive link 1810 and the longer stroke length, which are enabled by the rearwardly facing tabs 1824 and 1826, enable the linkage mechanism to move to a full recline (FIG. 18A) and to full closure. A full recline might be defined in various manners, and in one embodiment, a full recline is determined in part by a distance 1850 (FIG. 18D) of horizontal travel of the activator tube 350 from a closed configuration 1840 (e.g., FIGS. 3, 7, 8B, and 17A) to a reclined position 1844 (e.g., FIGS. 5, 8D, and 17C). In one embodiment, the distance of horizontal travel 1850 is in a range of at least about 8.9 inches to about 9.8 inches. For example, in the linkage configuration depicted by FIGS. 18A-18D, the distance 1850 of horizontal travel by the activator tube 350 is about 8.917 inches. In the linkage configuration depicted by FIGS. 8A-8D, the distance of horizontal travel by the activator tube 350 is about 9.793 inches. These relative distances of horizontal travel are determined by various factors. For example, in the embodiment depicted in FIGS. 18A-18D, a length of the angle brackets 1814 and 1816 is longer than the angle brackets 383 and 393 included in the embodiment of FIGS. 8A-8D.

Other measurements and dimensions are also useful to define a mechanism that functions to properly adjust between closed and reclined arrangements. For example, in one embodiment, the motor activator block 1812 includes a range of travel along the track 1820 that is at least 13 inches. In a further embodiment, the range of travel is about 14.25 inches. In addition, the drive link 1810 includes a distance between pivots 1828 and 1830 of at least 7 inches. In one embodiment, the distance between pivots 1828 and 1830 is about 7.2 inches. In a further embodiment, the distance between a center of the activator bar 350 (i.e., drive tube) and the pivot 1830 is at least 2 inches, and is preferably about 2.875 inches. The center of the activator bar 350 is logical as another measuring point as it includes a central axis around which the activator bar 350 rotates.

The drive link arrangement illustrated in FIGS. 18A-18D offers various cost-savings advantages. For example, the embodiment in FIGS. 18A-18D provides a materials-cost savings by only including a single drive link 1810, a single fastener between the drive link 1810 and the motor activator block 1812, a single fastener between the drive link 1810 and the angle brackets 1814 and 1816, and a single fastener between each angle bracket 1814 and 1816 and the angle bracket 315. In addition, because there are fewer elements to assemble, a labor-cost savings is realized.

Figure 8A:
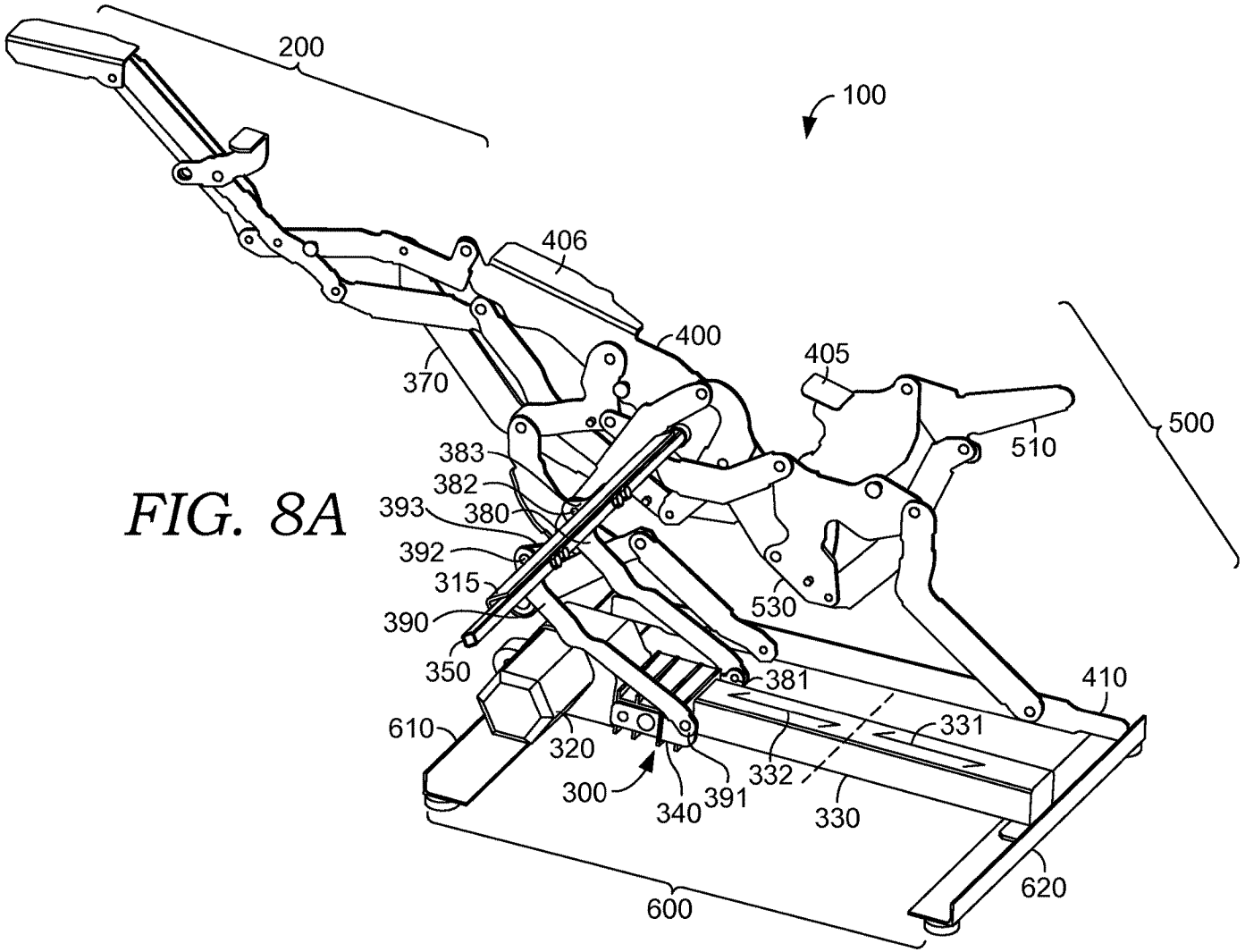
FIGS. 8A-8D show different views of a linkage mechanism, which includes a linear actuator that includes two drive links and that provides motorized adjustment of the seating unit, in accordance with an embodiment of the present invention.
Figure 8B:
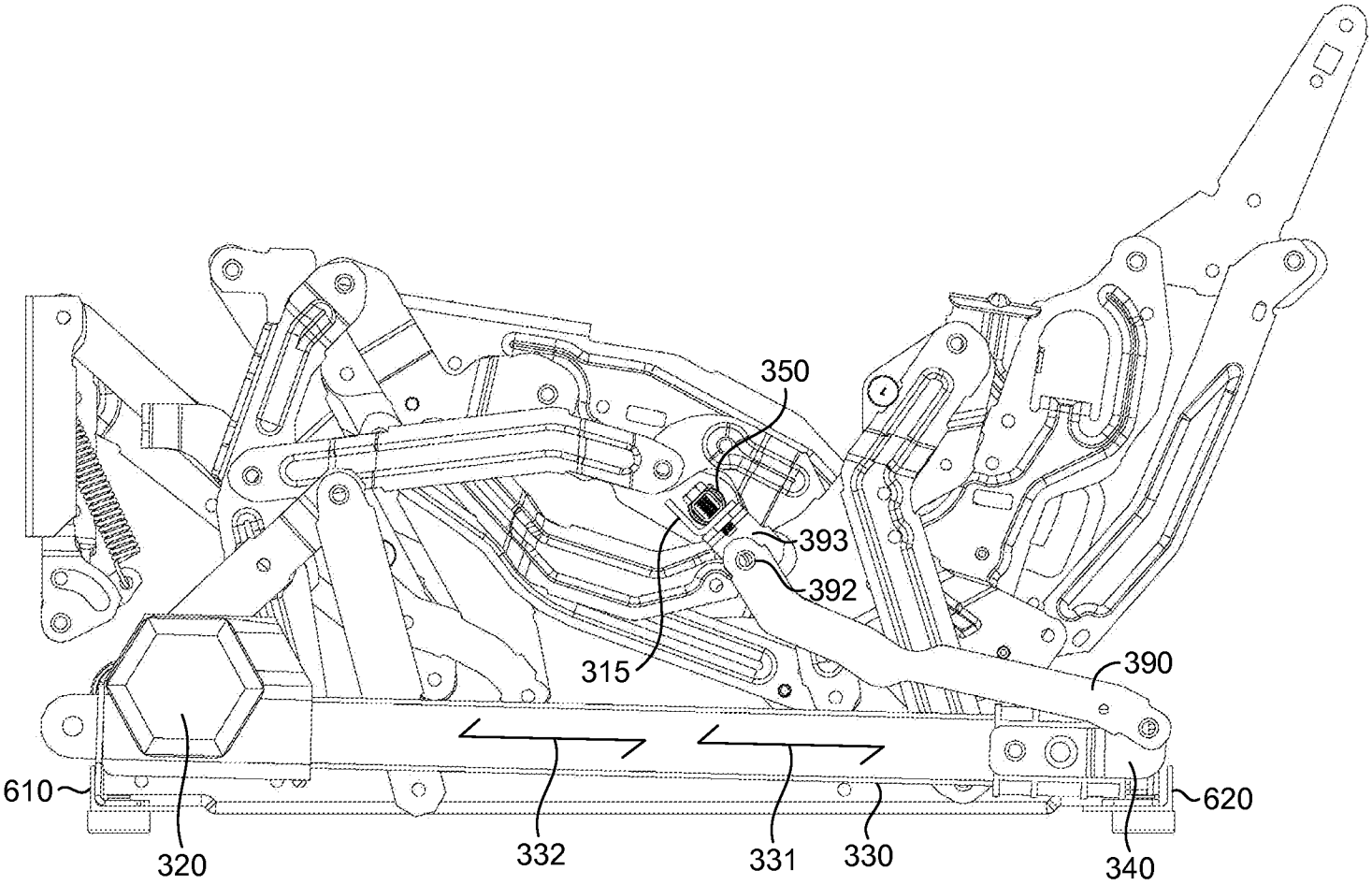
Figure 8C:
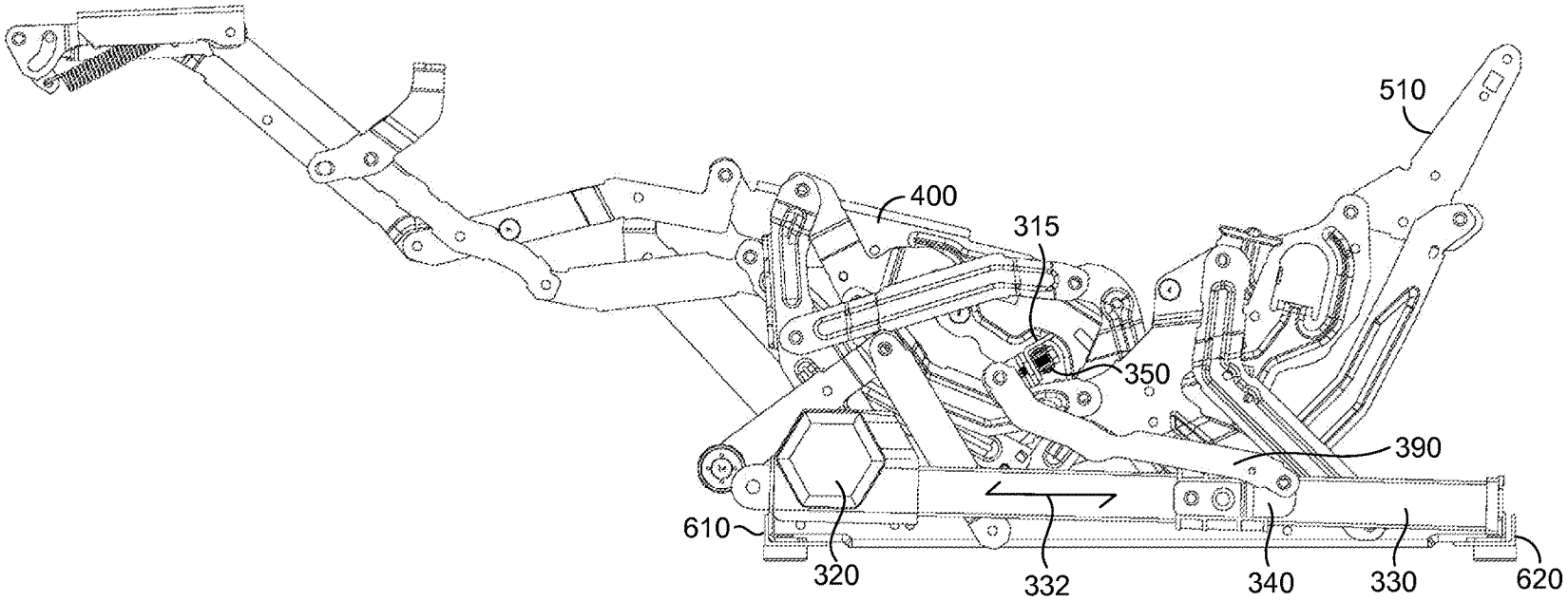
Figure 8D:
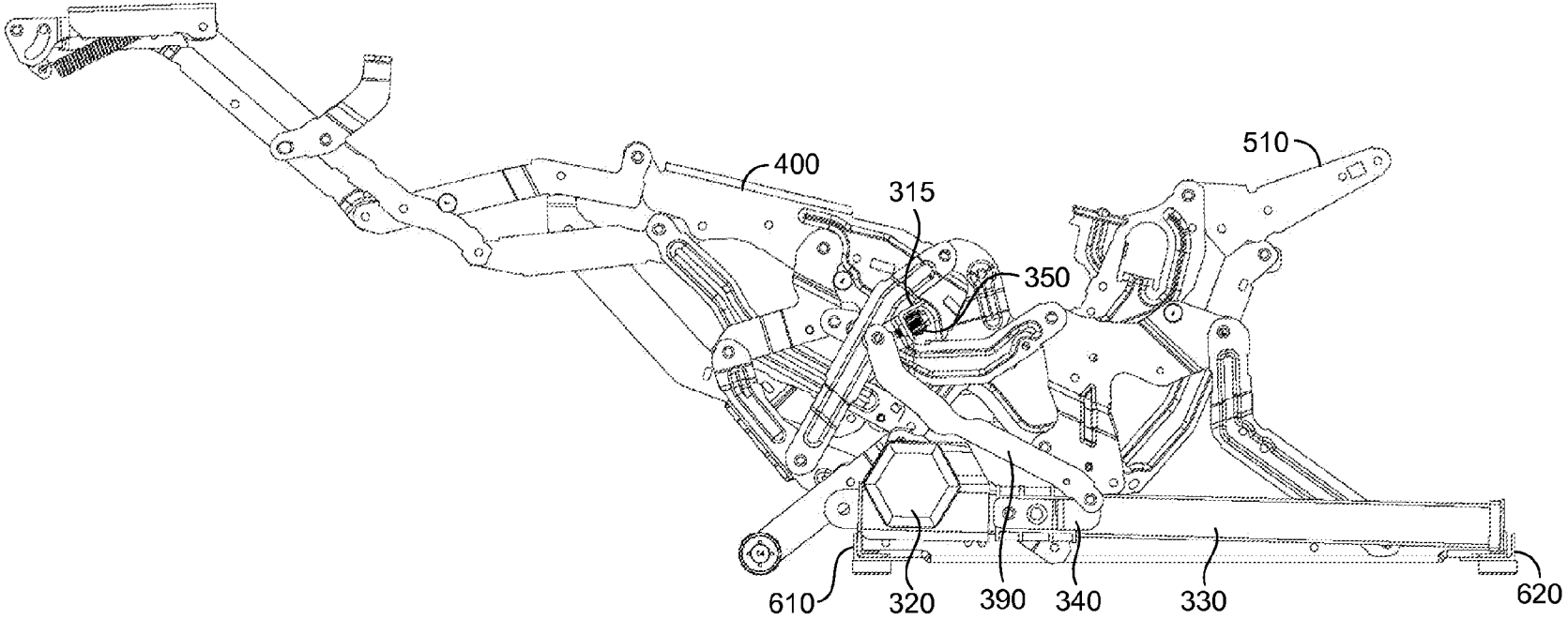
Figure 9:
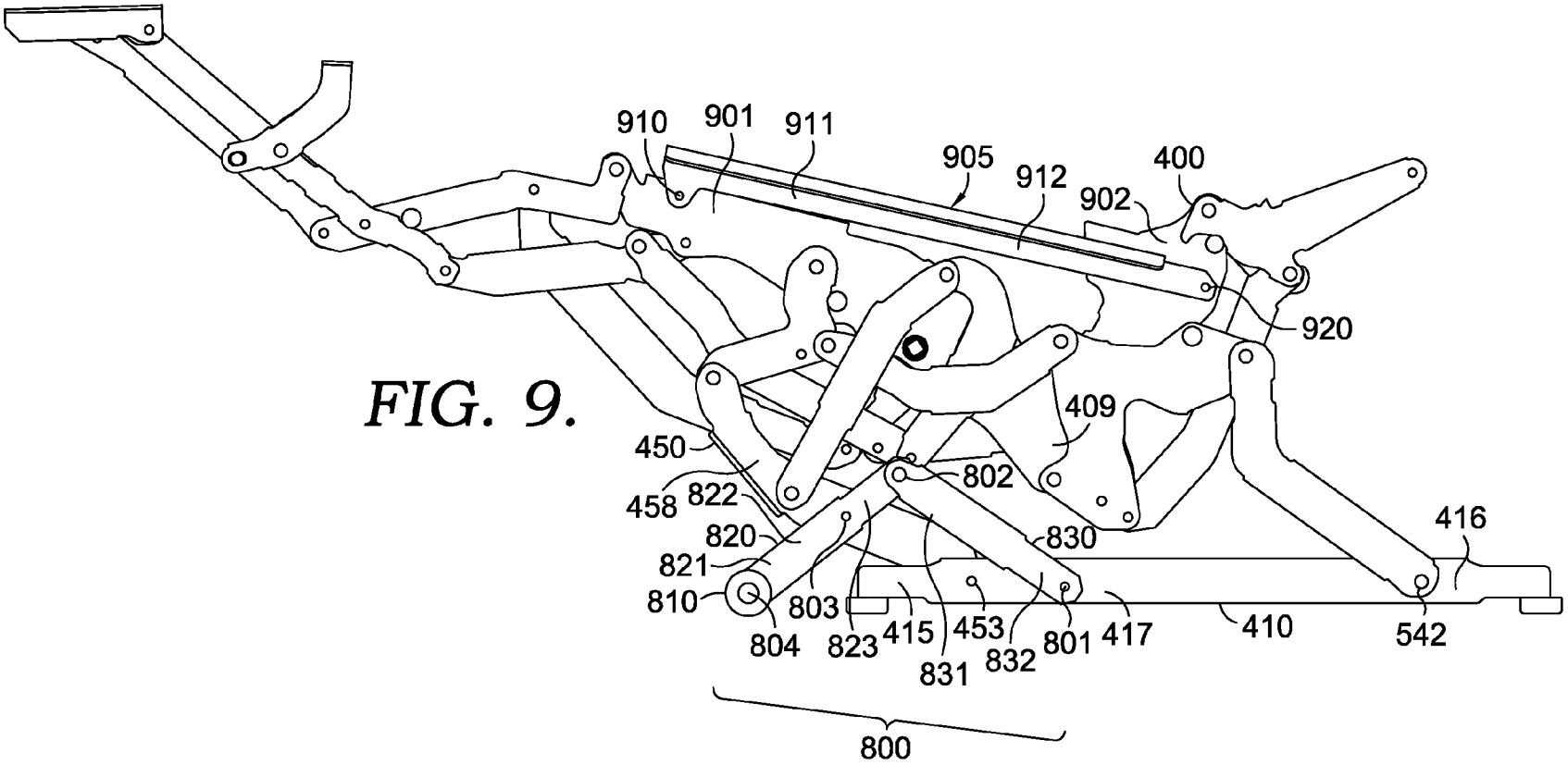
FIG. 9 is a diagrammatic lateral view of the linkage mechanism adjusted in the reclined position with an anti-tipping mechanism extended, in accordance with an embodiment of the present invention.

Referring now to FIGS. 8A and 9, embodiments of the seat-mounting plate 400 will now be described. In one instance, the seat-mounting plate 400 is provided with a forward and rearward tab, indicated by reference numerals 406 and 405, respectively. These tabs 405 and 406 are typically formed into an upper portion of the seat-mounting plate 400 to hold the seat structure (see reference numeral 12 of FIGS. 1-3). By way of example, the tabs 405 and 406 may be formed in substantially perpendicular relation to the remainder of the seat-mounting plate 400. As such, the tabs 405 and 406 of the seat-mounting plate 400, in conjunction with similarly configured tabs of a complimentary seat-mounting plate residing in substantial parallel-spaced relation with the seat-mounting plate 400, define the seating support surface that extends between the seat-mounting plates.

In an exemplary embodiment, the seat-mounting plate 400 and the complimentary seat-mounting plate each include a one-piece seat guard 905 fixedly attached thereto. Generally, the seat guard 905 spans a length of the seating support surface described above. As illustrated in FIG. 9, the seat guard 905 includes a front end 911 and a back end 912. The seat guard 905 may be fixedly attached at the front end 911 to the forward portion 901 of the seat-mounting plate 400, at pivot 910, and may be fixedly attached at the back end 912 to the rear portion 902 of the seat-mounting plate 400, at pivot 920. In operation, the seat guard 905 prevents links of the linkage mechanism 100 from cutting into foam, webbing, or other material that comprises the seat of the seating unit.

Figure 10:
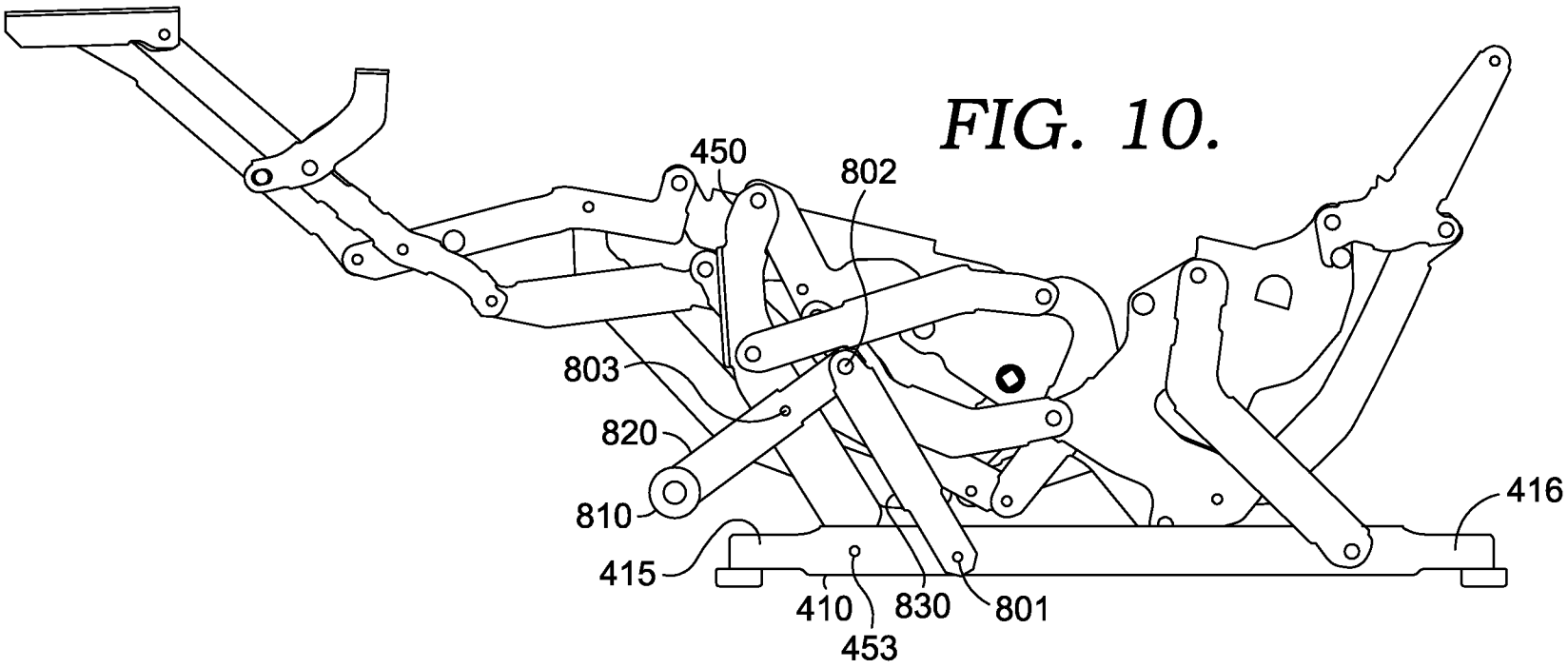
FIG. 10 is a view similar to FIG. 9, but in the extended position with the anti-tipping mechanism retracted, in accordance with an embodiment of the present invention.

Referring to FIGS. 9 and 10, the configuration and operation of an anti-tipping mechanism 800 will now be discussed. Initially, the anti-tipping mechanism 800 is typically installed on automated versions of the present invention (e.g., including the linear actuator 300) in order to prevent the seating unit from tipping forward when adjusted to the reclined position. The manually adjustable linkage mechanisms 100 of FIGS. 1-7 and 17A-17C will naturally adjust from the reclined position to the extended position when the occupant of the seating unit leans forward and satisfies the balance threshold (described above). However, the automated versions remain statically fixed in the reclined position upon the occupant leaning forward. This shift in occupant weight, combined with the forwardly displaced weight of the extended footrest assembly 200, potentially unbalances the seating unit inducing it to tip forward. Accordingly, the anti-tipping mechanism 800 extends forward in the reclined position to provide additional stabilization to the unbalanced seating unit.

Generally, the anti-tipping mechanism 800 includes a contact element 810, a rearward member 830 that has an upper end 831 and a lower end 832, and a forward member 820 that has an upper end 823, a lower end 821, and a mid section 822. The lower end 832 of the rearward member 830 is rotatably coupled to a mid portion 417 of the base plate 410 at pivot 801. The upper end 831 of the rearward member 830 is pivotably coupled to the upper end 823 of the forward member 820 at pivot 802. The mid section 822 of the of the forward member 820 is pivotably coupled to the mid portion 458 of the front pivot link 450 at pivot 803. The lower end 821 of the forward member 820 is coupled to the contact element 810 at pivot 804. As used herein, the phrase "contact element" 810 may generally refer to any component capable of withstanding repeated contact with the underlying surface and configured with sufficient rigidity to promote stability of the seating unit (e.g., plastic roller, rubber pad, and the like).

In operation, the anti-tipping mechanism 800 extends the contact element 810 forward and downward towards the underlying surface (not shown) when the linkage mechanism 100 is adjusted to the reclined position (see FIG. 9). That is, the forward swing of the front pivot link 450 about the pivot 453, when adjusting to the reclined position, extends the forward member 820, such that the members 820 and 830 form an obtuse angle. In a contrary fashion, the anti-tipping mechanism 800 retracts the contact element 810 away from the underlying surface when the linkage mechanism 100 is adjusted from the reclined position to the extended position (see FIG. 10). That is, the rearward swing of the front pivot link 450, when adjusting to the extended position, retracts the forward member 820, such that the members 820 and 830 form an acute angle.

Turning to FIGS. 11-14 and 16, a configuration of a sequence plate 550, a sequence element 560, and a front sequence link 570 will now be discussed. As with the anti-tipping mechanism 800, the components 550, 560, and 570 are typically installed on the automated version of the linkage mechanism 100. One reason for installing the components 550, 560, and 570 on the automated version is to correct for the case where the weight of the legs of the occupant of the seating unit causes the seat to raise and/or the backrest to recline out of sequence (i.e., prior to fully achieving adjustment to the extended position).

Figure 16:
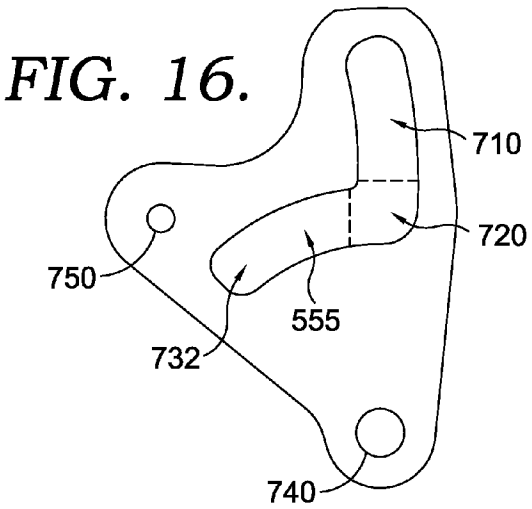
FIG. 16 is a diagrammatic lateral view of the sequence plate disassembled from the linkage mechanism, in accordance with an embodiment of the present invention.

As illustrated in FIGS. 11 and 16, the sequence plate 550 includes a guide slot 555, an aperture 740 for receiving hardware to form pivot 551, and an aperture 750 for receiving hardware to form pivot 556. The guide slot 555 is machined or formed within the sequence plate 550 and includes a first region 710, a second region 732, and an intermediate region 720 that interconnects the first region 710 and the second region 732. In embodiments, the guide slot 555 is generally L-shaped and the first region 710 is substantially vertical while the second region 732 is substantially horizontal.

The sequence plate 550 is rotatably coupled to an exterior side of the rear bellcrank 530. In one instance, the rotatable coupling occurs at the pivot 551, which is located at the lower portion 537 (see FIG. 6) of the rear bellcrank 530. A rearward end of the front sequence link 570 is pivotably coupled to the sequence plate 550 at the pivot 556. A forward end of the front sequence link 570 is pivotably coupled to the back end 591 (see FIG. 6) of the footrest drive link 590 at pivot 571. As such, adjustment of the footrest drive link 590 between the closed position (see FIG. 12) and extended position (see FIG. 13) may, in turn, articulably actuate the front sequence link 570 laterally. This lateral actuation causes the sequence plate 550 to rotate forward and backward about the pivot 551. Consequently, the rotation of the sequence plate 550 changes a relative position of the sequence element 560 within the guide slot 555.

Typically, the sequence element 560 is configured as a bushing or cylindrically shaped element that can effortlessly ride or travel within the guide slot 555. The sequence element 560 is fixedly attached to the mid portion 409 of the seat-mounting plate 400 on the exterior side, which is the side opposed to the rear bellcrank 530. Generally, the sequence element 560, at least partially, extends into the guide slot 555. In a particular embodiment, the sequence element 560 fully extends through the guide slot 555 and includes a cap (not shown) that retains the sequence plate 550 onto the sequence element 560.

The interaction between the components 550, 560, and 570 will now be discussed. Initially, the sequence element 560 resides within the second region 732 when the seating unit is adjusted to the closed position (see FIG. 12). When captured within the second region 732 of the guide slot 555, the interaction between the sequence element 560 and the sequence plate 550 resists adjustment of the seating unit to the reclined position. However, when the seating unit is adjusted to the extended position (see FIG. 13), by forwardly actuating the front sequence link 570 as discussed above, the sequence element 560 is shifted to reside within the intermediate region 720, or elbow, of the guide slot 555. When residing in the intermediate region 720, the seating unit is free to be adjusted to either the closed position or the reclined position, as the guide slot 555 allows two-directions of movement of the sequence element 560 from the intermediate region 720.

The seating unit may then be adjusted from the extended position to the reclined position (see FIG. 14) via manual or automated control. This adjustment causes the seat-mounting plate 400 to rise and to shift the sequence element 560 to reside within the first region 710. When the sequence element 560 resides within the first region 710 of the guide slot 555, the interaction of the sequence element 560 and the sequence plate 550 resists adjustment of the seating unit to the closed position. Accordingly, the sequencing described above ensures that adjustment of the footrest assembly 200 between the closed and extended positions is not interrupted by rotational biasing of the backrest, or vice versa. In other embodiments, the weight of the occupant of the seating unit and/or springs interconnecting links of the seat-adjustment assembly 500 assist in creating or enhancing the sequencing.

Referring to FIG. 15, an exemplary configuration of the base plate 410 will now be described. Initially, the base plate 410 includes the front end 415 and the back end 416 (see FIG. 9). Further, a substantially perpendicular bend 980 may constitute a lower edge of the base plate 410. In an exemplary embodiment, the base plate 410 has a step 960 formed into the bend 980 at the lower edges thereof. The formed step 960 may be located at the front end 415 of the base plate 410 (not shown), the back end 416 of the base plate 410 (see FIG. 15), or both. As illustrated in FIG. 15, the formed step 960 may provide a raised section 970 that fixedly attaches to one of the lateral members 610 or 620 that serve as crossbeams spanning the base plates.

Further, the raised section 970 may compensate for a height of the support bushings 411 and 412, thereby allowing a majority of the bend 980 of the base plate 410 to reside at a level below a top of the support bushings 411 and 412. In this way, the links of the linkage mechanism 100 may be designed to be longer and cover a wider throw (greater swing-range) when pivoting. These features of longer length and wider throw are beneficial in accomplishing more movement of the seat-mounting plate 400 and gaining more wall clearance during recline of the backrest. Also, the formed step 960 provides structural support and reinforcement to the ends 415 and 416 of the base plate 410, thus, allowing the base plate 410 to be fabricated from a thinner plate. In practice, the reinforced ends 415 and 416 of the base plate 410 resist bending, deformation, or other damage that results from dropping during transport or caused by other common abuse when handling.

It should be understood that the construction of the linkage mechanism 100 lends itself to enable the various links and brackets to be easily assembled and disassembled from the remaining components of the seating unit. Specifically the nature of the pivots and/or mounting locations, allows for use of quick-disconnect hardware, such as a knock-down fastener. Accordingly, rapid disconnection of components prior to shipping, or rapid connection in receipt, is facilitated.

The present invention has been described in relation to particular embodiments, which are intended in all respects to be illustrative rather than restrictive. Alternative embodiments will become apparent to those skilled in the art to which the present invention pertains without departing from its scope.

It will be seen from the foregoing that this invention is one well adapted to attain the ends and objects set forth above, and to attain other advantages, which are obvious and inherent in the device. It will be understood that certain features and subcombinations are of utility and may be employed without reference to other features and subcombinations. This is contemplated by and within the scope of the claims. It will be appreciated by persons skilled in the art that the present invention is not limited to what has been particularly shown and described hereinabove. Rather, all matter herein set forth or shown in the accompanying drawings is to be interpreted as illustrative and not limiting.

What is claimed is:

1. An improved adjustment mechanism for a seating unit of the type having a motor, a track that is coupled to the motor and that extends from a front portion of the seating unit to a rear portion of the seating unit, a motor activator block slidably coupled to the track and movable along the track using the motor, and a single drive link that is attached to the motor activator block, wherein the improvement includes:

a carriage body that slidably attaches the motor activator block to the track, and one or more mounting tabs that extend from a top surface of the carriage body toward the rear portion of the seating unit and that are coupled to the single drive link.

2. The improved adjustment mechanism of claim 1, wherein the single drive link is pivotably coupled at a first pivot to the one or more mounting tabs and pivotably coupled at a second pivot to one or more angle brackets, wherein a distance of at least 7 inches is between the first pivot and the second pivot.

3. The improved adjustment mechanism of claim 2, wherein the one or more angle brackets are coupled to a drive tube, and wherein a distance of at least 2 inches extends between the second pivot and an axis of rotation of the drive tube.

4. The improved adjustment mechanism of claim 3, wherein the motor activator block includes a range of travel along the track and wherein the range of travel is at least 13 inches.

5. A seating unit including a linear actuator for controlling a position of a seating-unit footrest and a seating-unit recline, the seating unit comprising:

a front lateral member positioned in a front portion of the seating unit and a rear lateral member positioned in a rear portion of the seating unit, the front lateral member and the rear lateral member providing at least part of a base for the seating unit;

a motor coupled to the front lateral member;

a track that is coupled to the motor and to the rear lateral member; and a motor activator block slidably coupled to the track and movable along the track using the motor, wherein the motor activator block includes a carriage body that slidably couples the motor activator block to the track and one or more mounting tabs that extend from a top surface of the carriage body in a direction towards the rear portion of the seating unit.

6. The seating unit of claim 5 further comprising, a drive link pivotably coupled at a first pivot to the one or more mounting tabs and pivotably coupled at a second pivot to one or more angle brackets, wherein a distance of at least about 7 inches is between the first pivot and the second pivot.

7. The seating unit of claim 6, wherein the one or more angle brackets are coupled to a drive tube, and wherein a distance of at least about 2 inches extends between the second pivot and a center of the drive tube.

8. The seating unit of claim 7, wherein the motor activator block includes a range of travel along the track and wherein the range of travel is at least about 13 inches.

9. The seating unit of claim 7, wherein the seating unit adjusts between a standard position and a reclined position and wherein the drive tube is generally horizontally traversed a distance in a range of about 8.9 inches to about 9.8 inches when the seating unit adjusts from the standard position to the reclined position.

10. The seating unit of claim 9, wherein the distance traversed by the drive tube is at least partially determined based on a length of the one or more angle brackets.

11. The seating unit of claim 7, wherein the drive tube rotates when the seating unit is adjusted from a standard position to an extended position, and wherein a degree of rotation is in a range of about 104 degrees and about 104.815 degrees.

12. The seating unit of claim 6, wherein the seating unit only includes a single drive link.

13. A seating unit comprising:

a pair of base plates in substantially parallel-spaced relation;

a front lateral member and a rear lateral member in substantially parallel-spaced relation and coupled between the pair of base plates;

a pair of seat-mounting plates in substantially parallel-spaced relation, wherein each of the seat-mounting plates is disposed in an inclined orientation in relation to each of the base plates, respectively;

an activator bar that is rotatably mounted to, and that extends between, each of the seat-mounting plates;

a pair of angle brackets that are coupled to the activator bar;

a single drive link that includes a first pivot and a second pivot and that is rotatably coupled at the first pivot to the pair of angle brackets;

a motor activator block that is rotatably coupled at the second pivot of the drive link, wherein the motor activator block includes a carriage body that slidably couples the motor activator block to a track and one or more mounting tabs that extend from a top surface of the carriage body, and wherein the one or more mounting tabs extend in a direction toward the rear lateral member; and a motor coupled to the track and positioned near the front lateral member, wherein the motor translates the motor activator block along the track.

14. The seating unit of claim 13, wherein a distance of at least 7 inches is between the first pivot and the second pivot of the single drive link.

15. The seating unit of claim 13, wherein a distance of at least 2 inches extends between the first pivot and a center of the activator bar.

16. The seating unit of claim 13, wherein the motor activator block includes a range of travel along the track and wherein the range of travel is at least 13 inches.

17. The seating unit of claim 13, wherein the seating unit adjusts between a standard position and a reclined position and wherein the activator bar is generally horizontally traversed a distance in a range of about 8.9 inches to about 9.8 inches when the seating unit adjusts from the standard position to the reclined position.

18. The seating unit of claim 17, wherein the distance traversed by the activator bar is at least partially determined based on a length of the one or more angle brackets.

19. The seating unit of claim 13, wherein the activator bar rotates when the seating unit is adjusted from a standard position to an extended position, and wherein a degree of rotation is in a range of about 104 degrees and about 104.815 degrees.

* * * * *